US008220204B2

(12) United States Patent
Lee et al.

(10) Patent No.: US 8,220,204 B2
(45) Date of Patent: Jul. 17, 2012

(54) REFRIGERATOR DOOR AND METHOD OF MANUFACTURE THEREOF

(75) Inventors: Kab-Young Lee, Changwon (KR); Sang-Woo Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 876 days.

(21) Appl. No.: 11/996,017

(22) PCT Filed: Jul. 20, 2006

(86) PCT No.: PCT/KR2006/002856

§ 371 (c)(1),
(2), (4) Date: Jan. 17, 2008

(87) PCT Pub. No.: WO2007/011178

PCT Pub. Date: Jan. 25, 2007

(65) Prior Publication Data

US 2008/0231159 A1 Sep. 25, 2008

(30) Foreign Application Priority Data

| | | |
|---|---|---|
| Jul. 20, 2005 | (KR) | 10-2005-0065967 |
| Aug. 11, 2005 | (KR) | 10-2005-0073973 |
| Aug. 11, 2005 | (KR) | 10-2005-0073983 |
| Aug. 29, 2005 | (KR) | 10-2005-0079578 |
| Sep. 26, 2005 | (KR) | 10-2005-0089420 |
| Sep. 28, 2005 | (KR) | 10-2005-0090667 |
| Sep. 28, 2005 | (KR) | 10-2005-0090671 |

(51) Int. Cl.
*E06B 3/32* (2006.01)

(52) U.S. Cl. ..... 49/463; 49/171; 312/405

(58) Field of Classification Search ..... 49/171, 49/463, 465; 312/405, 405.1, 204
See application file for complete search history.

(56) References Cited

U.S. PATENT DOCUMENTS 2,766,856 A * 10/1956 Nelsson ..... 49/246
(Continued)

FOREIGN PATENT DOCUMENTS

JP 2-40478 A 2/1990
(Continued)

*Primary Examiner* — Katherine W Mitchell
*Assistant Examiner* — Catherine A Kelly
(74) *Attorney, Agent, or Firm* — Birch, Stewart, Kolasch & Birch, LLP

(57) ABSTRACT

The present invention relates to a refrigerator in which a front of a door is made of a glass plate and a display portion for showing and controlling a condition of the refrigerator is positioned on the rear of the glass plate not to protrude outward. The present invention comprises a door main body including: an outer door 50 defining a front of the door and having a display accommodating portion 54 defined by depression, a door liner 56 installed on the rear of the outer door 50, and upper, lower, left and right decorations for coupling them. In addition, the display accommodating portion 54 in the front of the door main body is mounted with a display portion 70 for showing and controlling a condition of the refrigerator. Also, a front glass plate 80 is installed on the front of the door main body and display portion 70. At this time, in order to stably arrange and secure the display portion 70 into the display accommodating portion 54, the display accommodating portion 54 may be stepwise formed, an elastic rib 262 may be provided, or a support plate 437 may be formed to extend. Further, in order to reduce the number of parts, the refrigerator door can be assembled by directly applying foam liquid to a front decoration 590 without the outer door 50.

23 Claims, 22 Drawing Sheets

U.S. PATENT DOCUMENTS

| | | | | |
|---|---|---|---|---|
| 5,359,795 | A | 11/1994 | Mawby et al. | |
| 5,806,942 | A * | 9/1998 | Jenkins et al. | 312/204 |
| 6,461,736 | B1 * | 10/2002 | Nagashima et al. | 428/432 |
| 6,682,161 | B2 * | 1/2004 | Yun | 312/405 |
| 7,516,625 | B2 * | 4/2009 | Kwon | 62/440 |
| 2003/0103023 | A1 * | 6/2003 | Ootsuka et al. | 345/87 |
| 2004/0177624 | A1 * | 9/2004 | Wo | 62/125 |
| 2004/0183413 | A1 * | 9/2004 | Koo | 312/401 |
| 2005/0006997 | A1 * | 1/2005 | Yoshioka | 312/405 |

FOREIGN PATENT DOCUMENTS

| | | | |
|---|---|---|---|
| JP | 2002-228342 | A | 8/2002 |
| JP | 2005-30716 | A | 2/2005 |
| JP | 3110325 | U | 5/2005 |
| KR | 10-1998-085094 | A | 12/1998 |
| KR | 20-0217350 | Y1 | 4/2001 |
| KR | 20-0328257 | Y1 | 9/2003 |
| KR | 10-2005-0059882 | A | 6/2005 |

* cited by examiner

【Figure 1】
Conventional Art
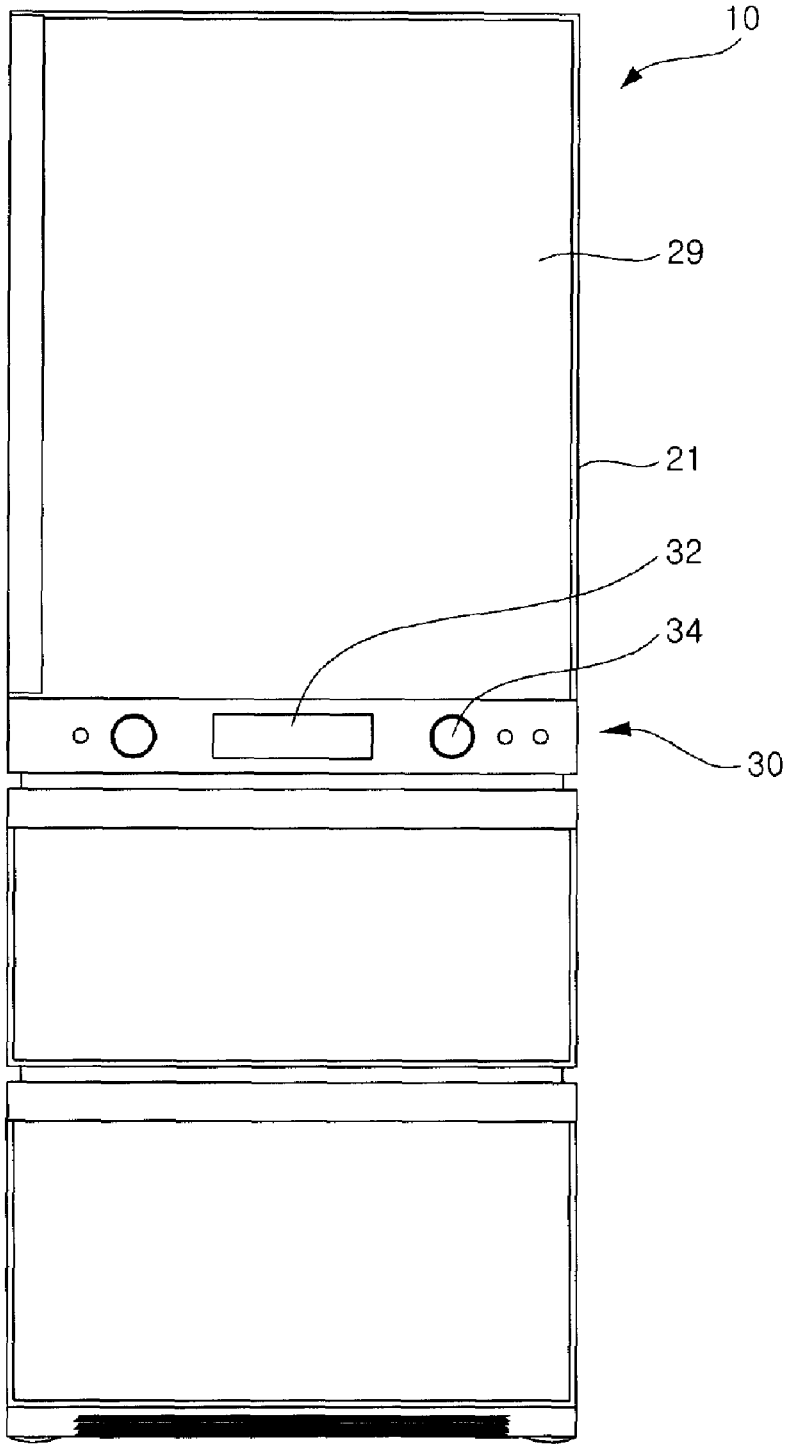

【Figure 2】
Conventional Art
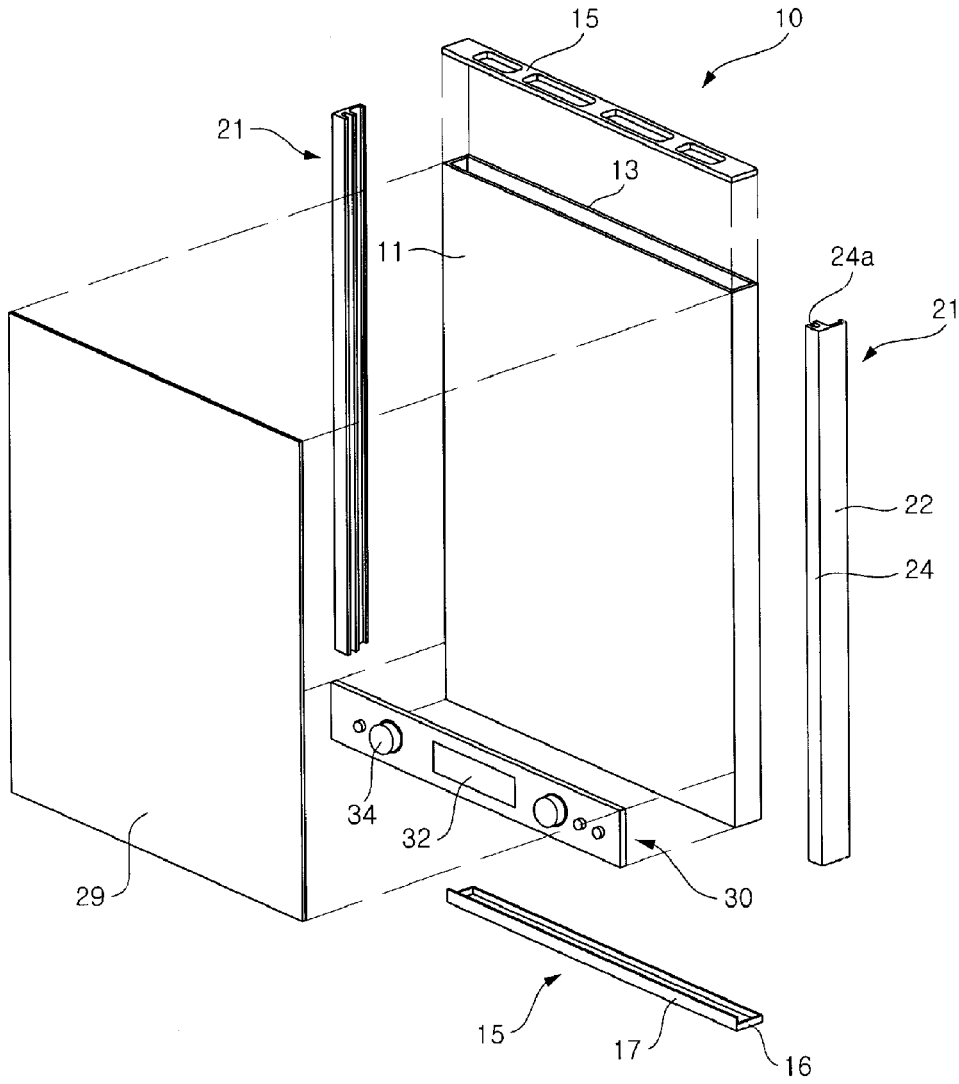

【Figure 3】
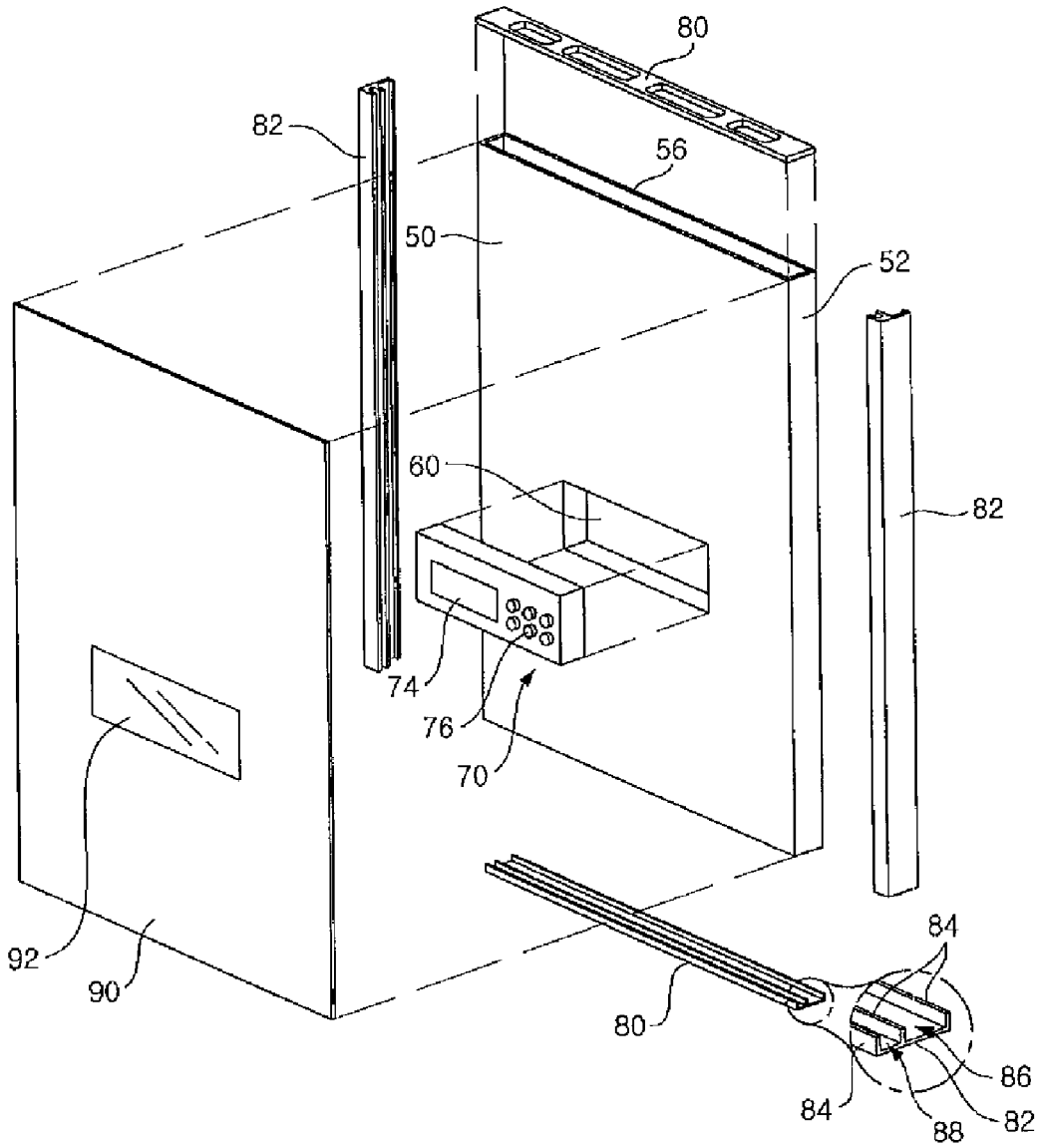

【Figure 4】
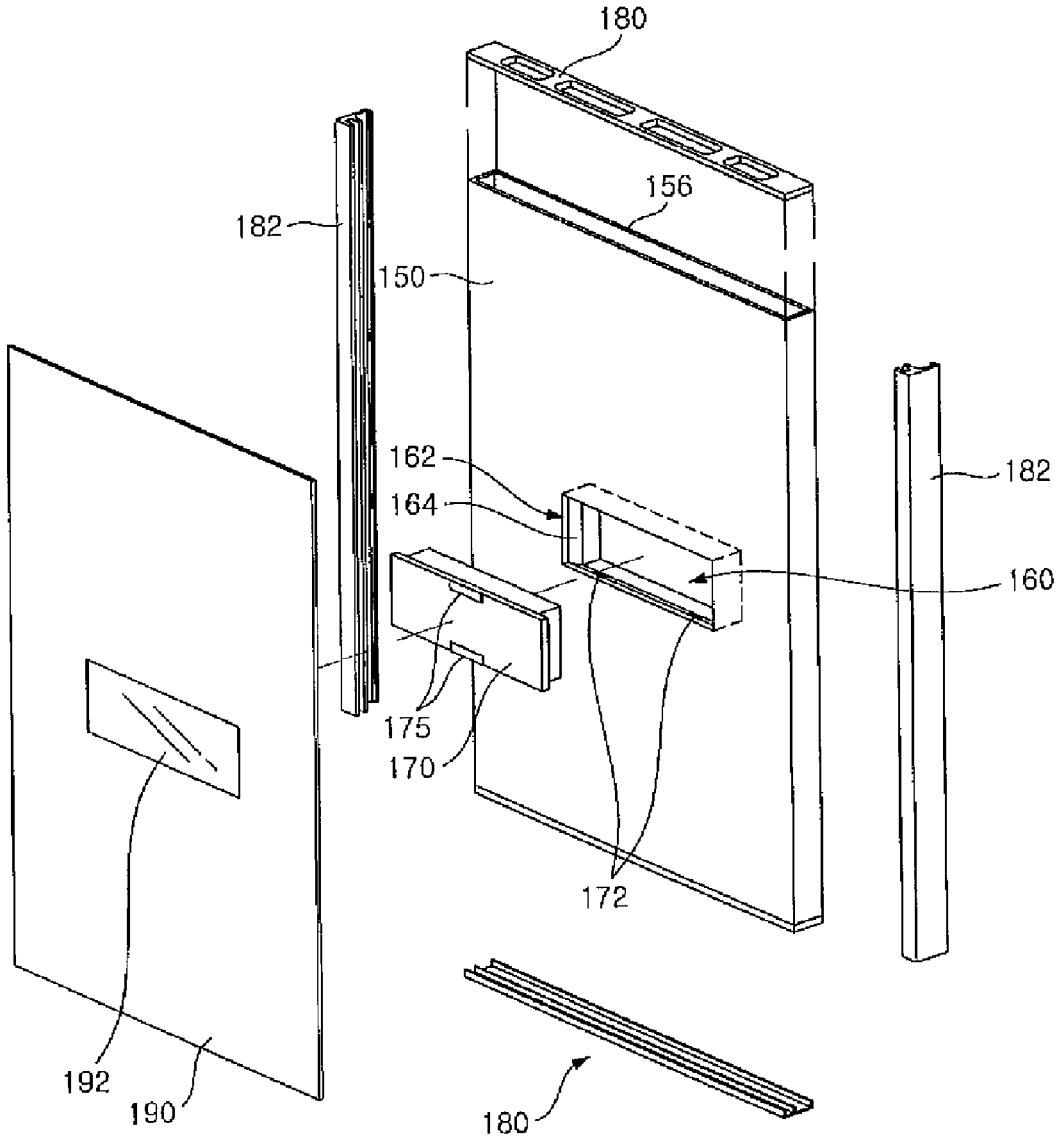

【Figure 5】
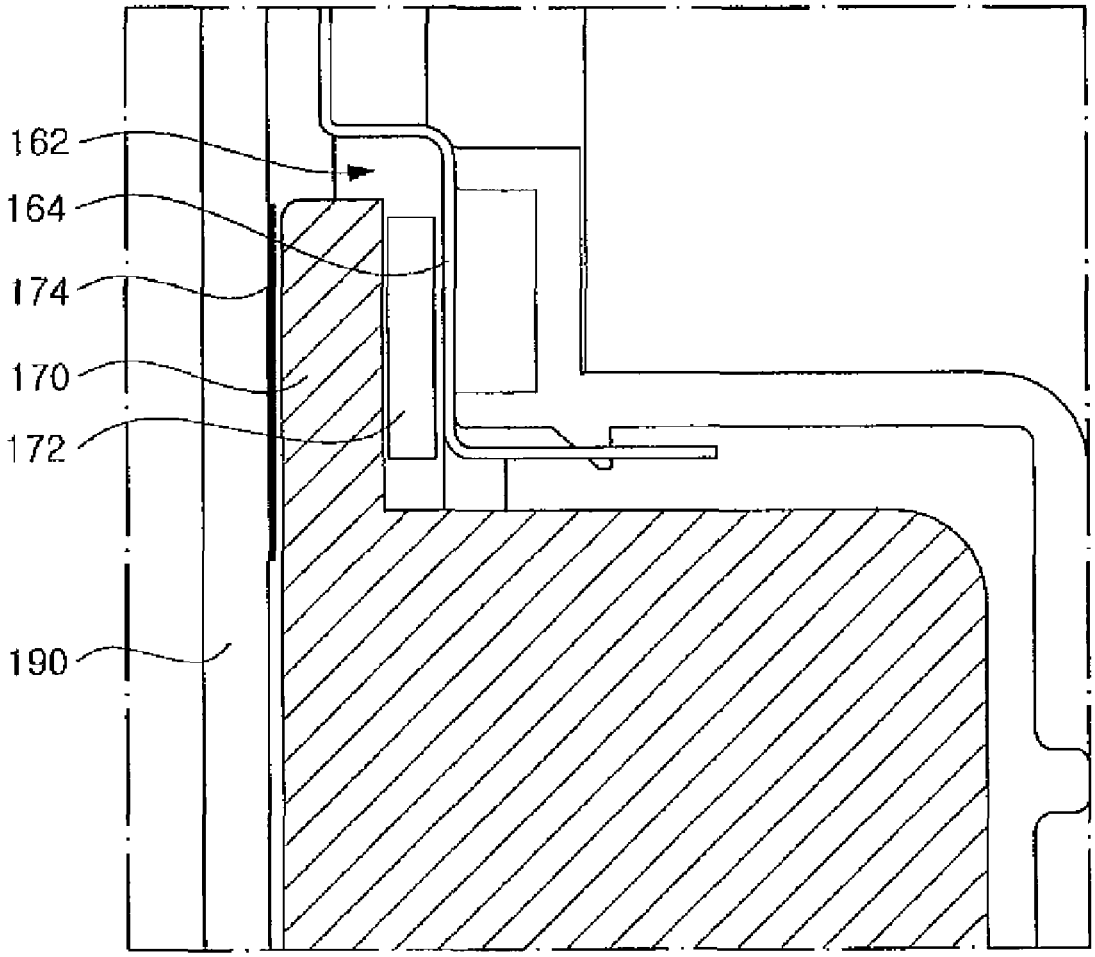

【Figure 6】
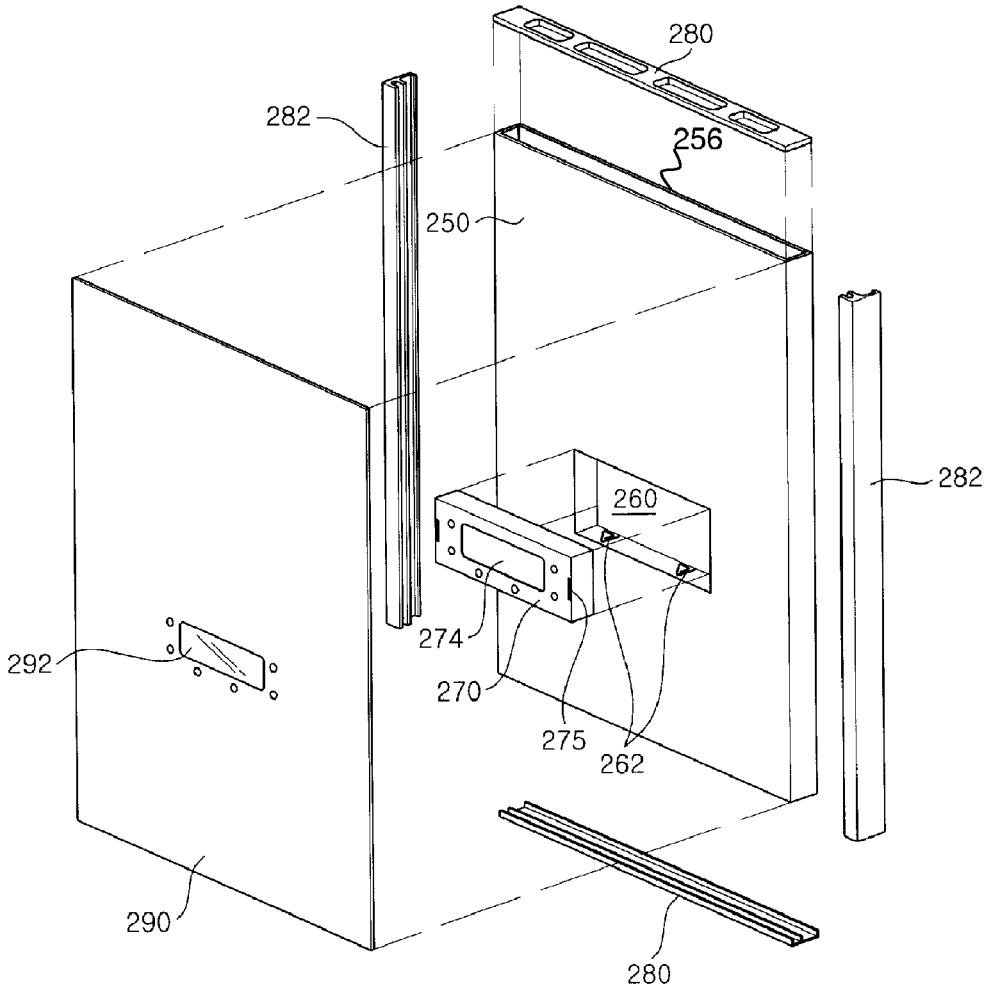

【Figure 7】
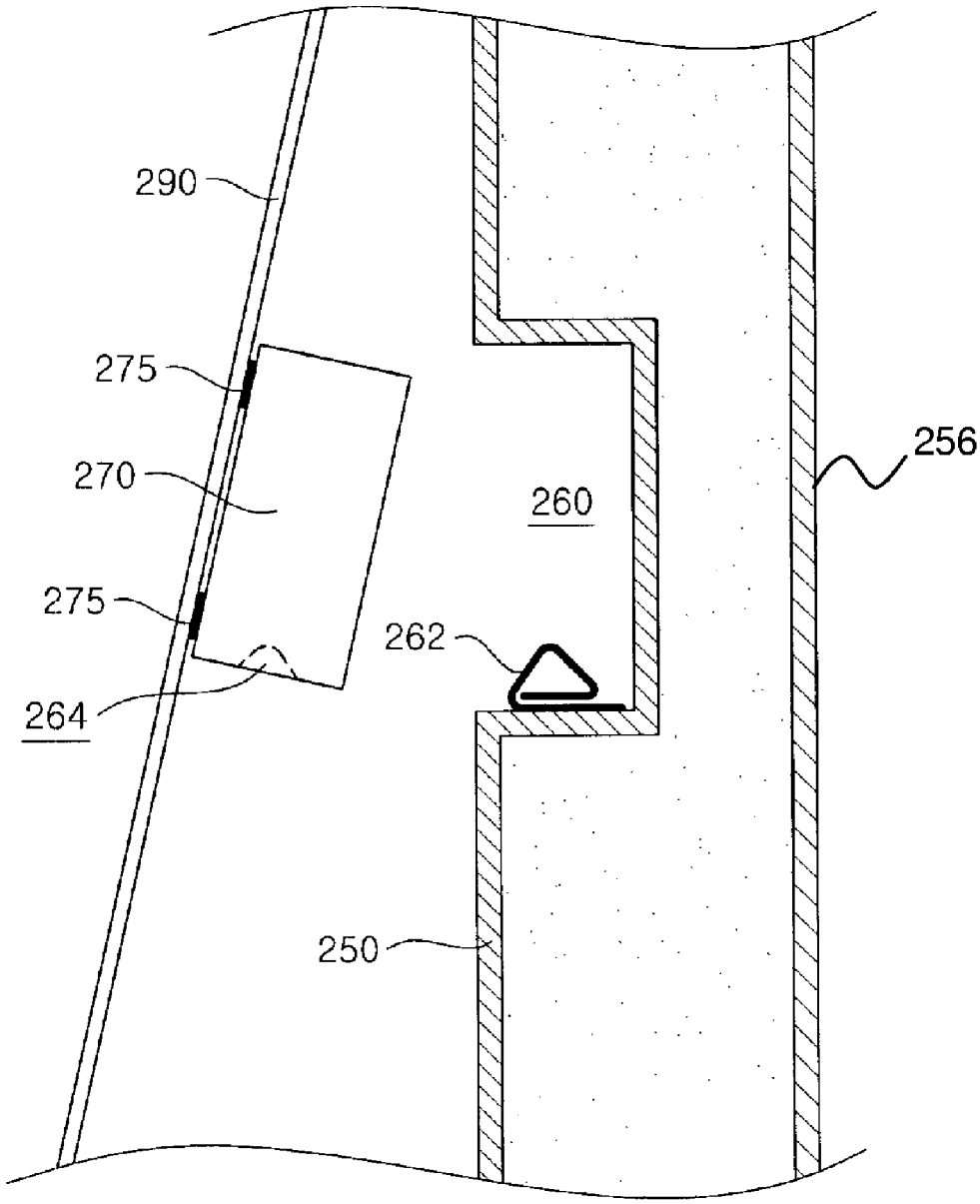

【Figure 8】
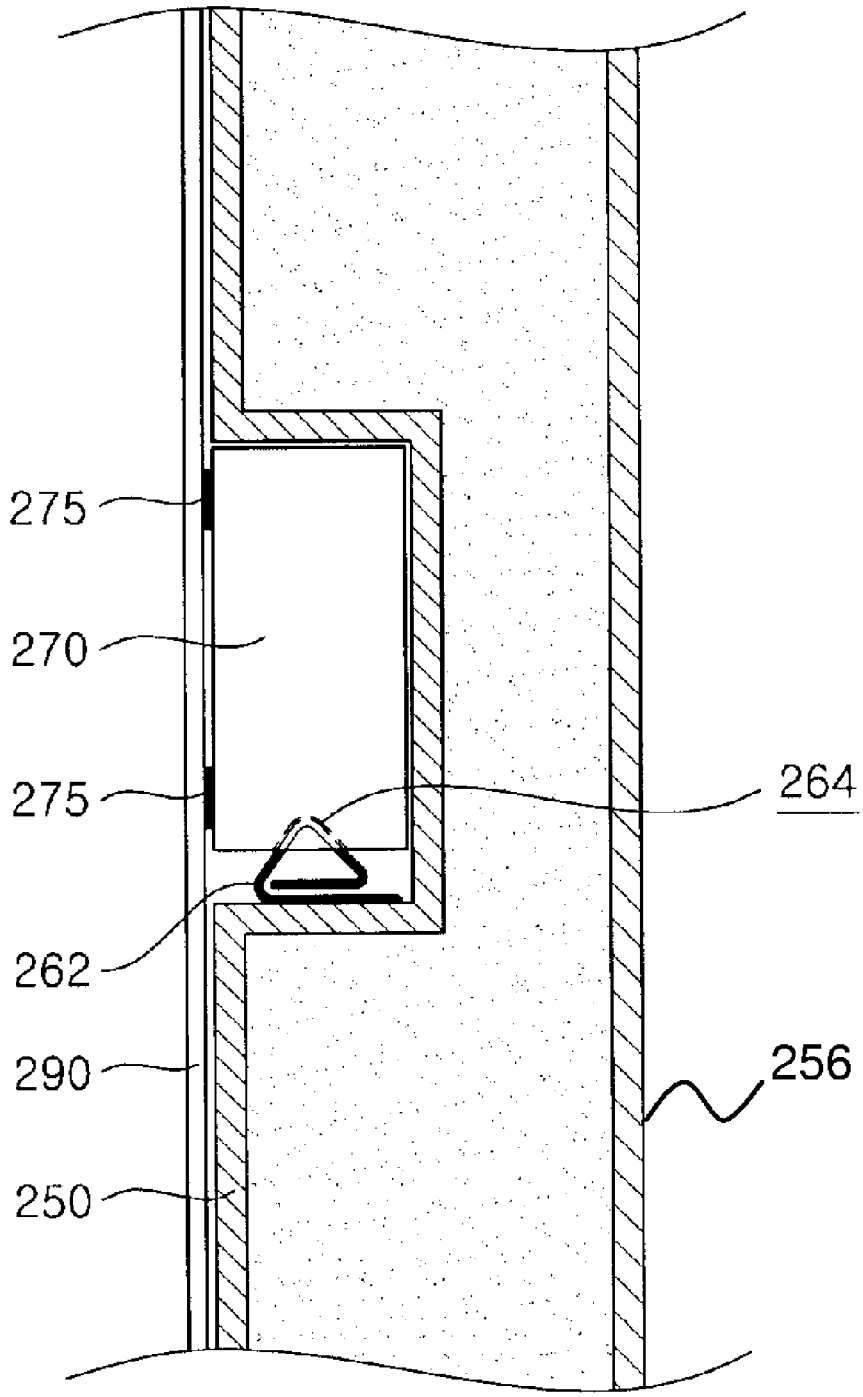

【Figure 9】
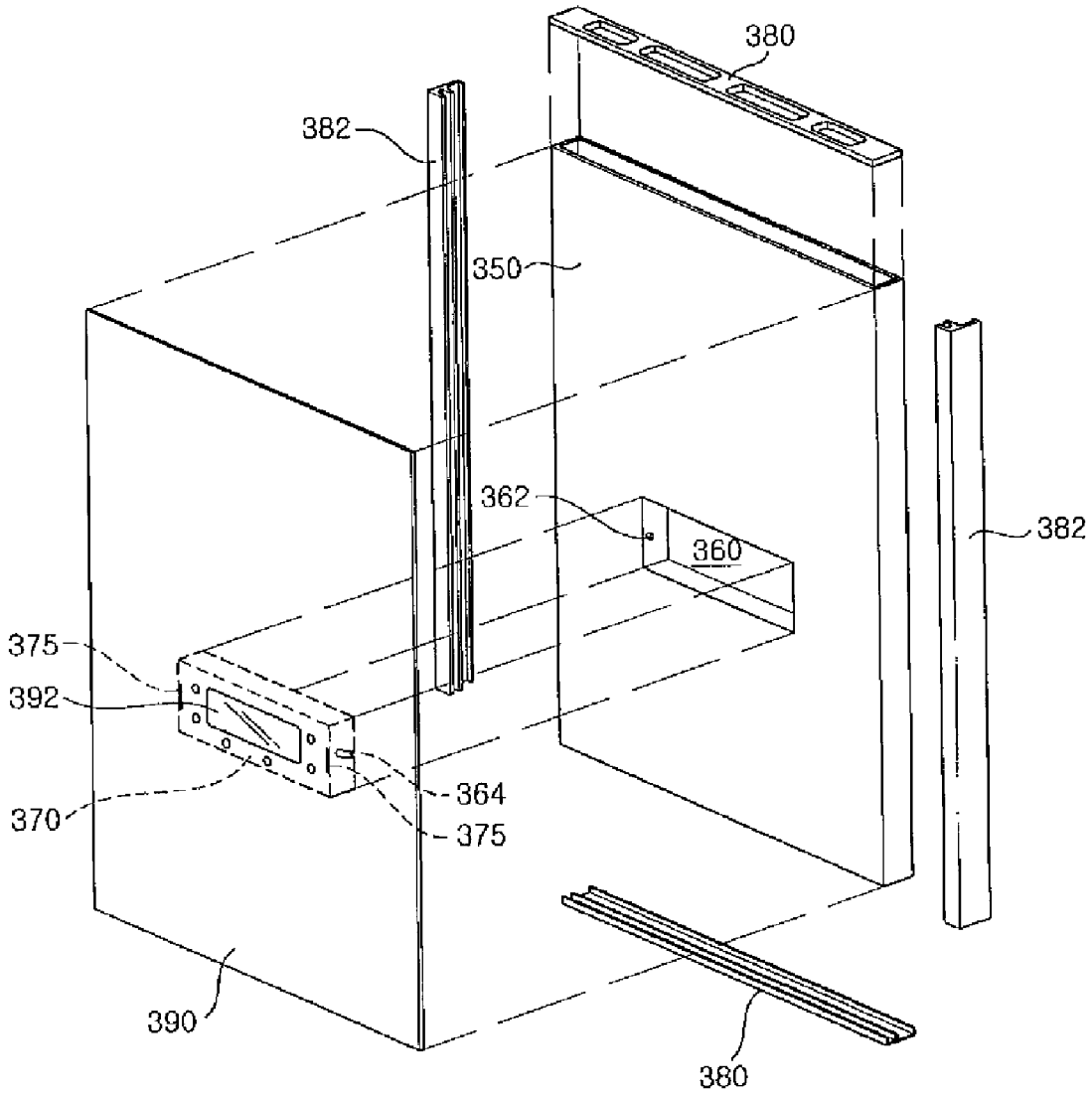

【Figure 10】
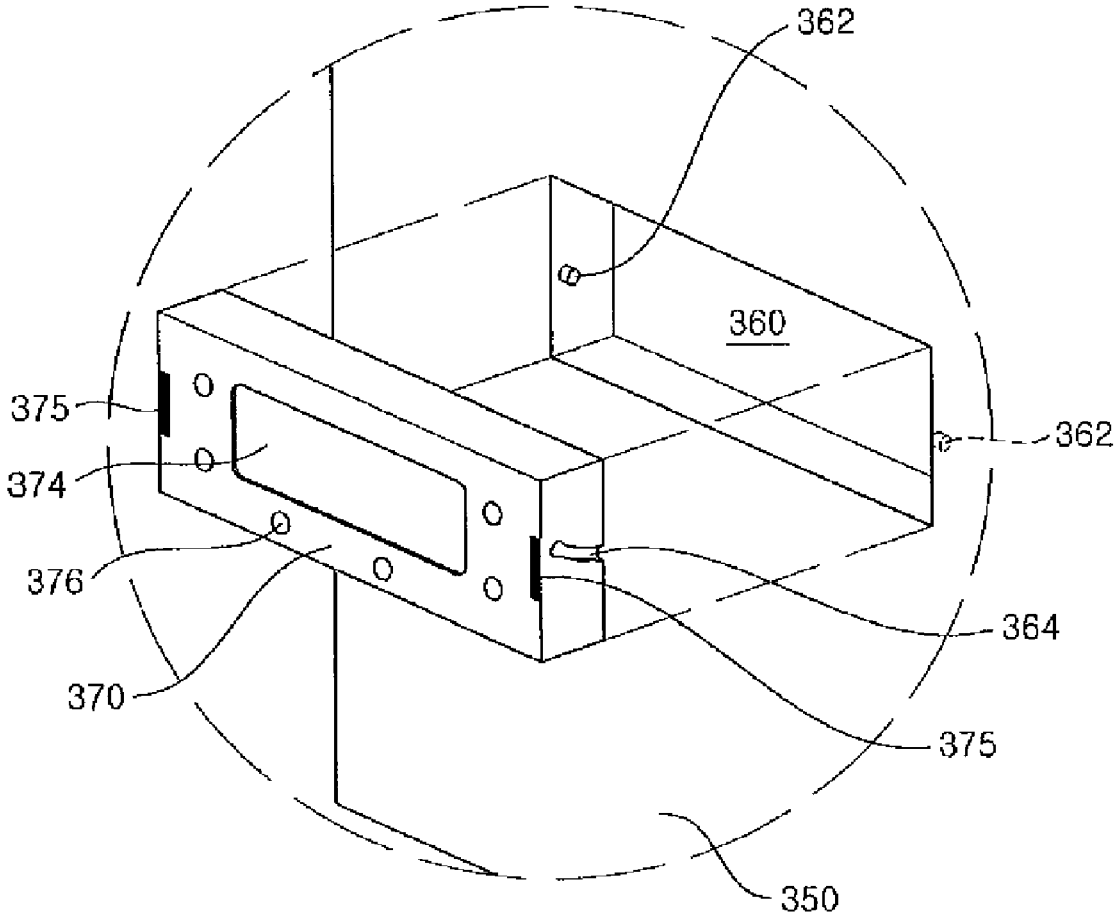

【Figure 11】
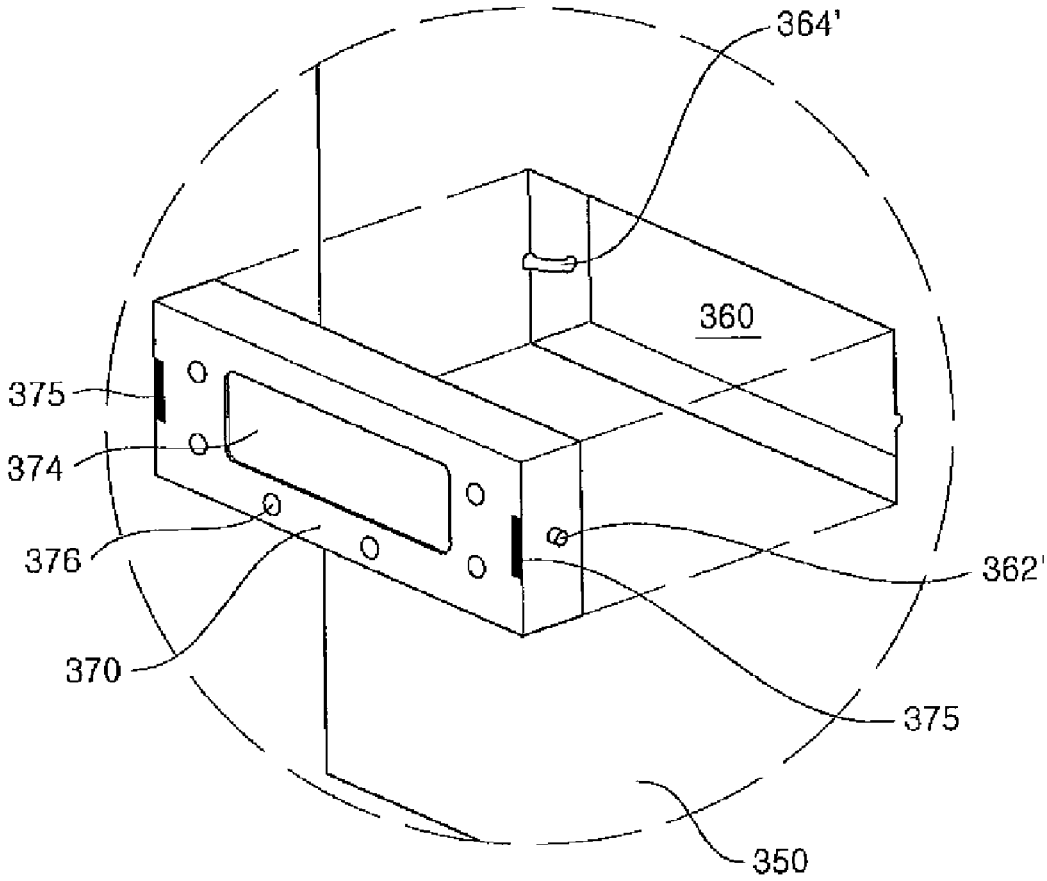

【Figure 12】
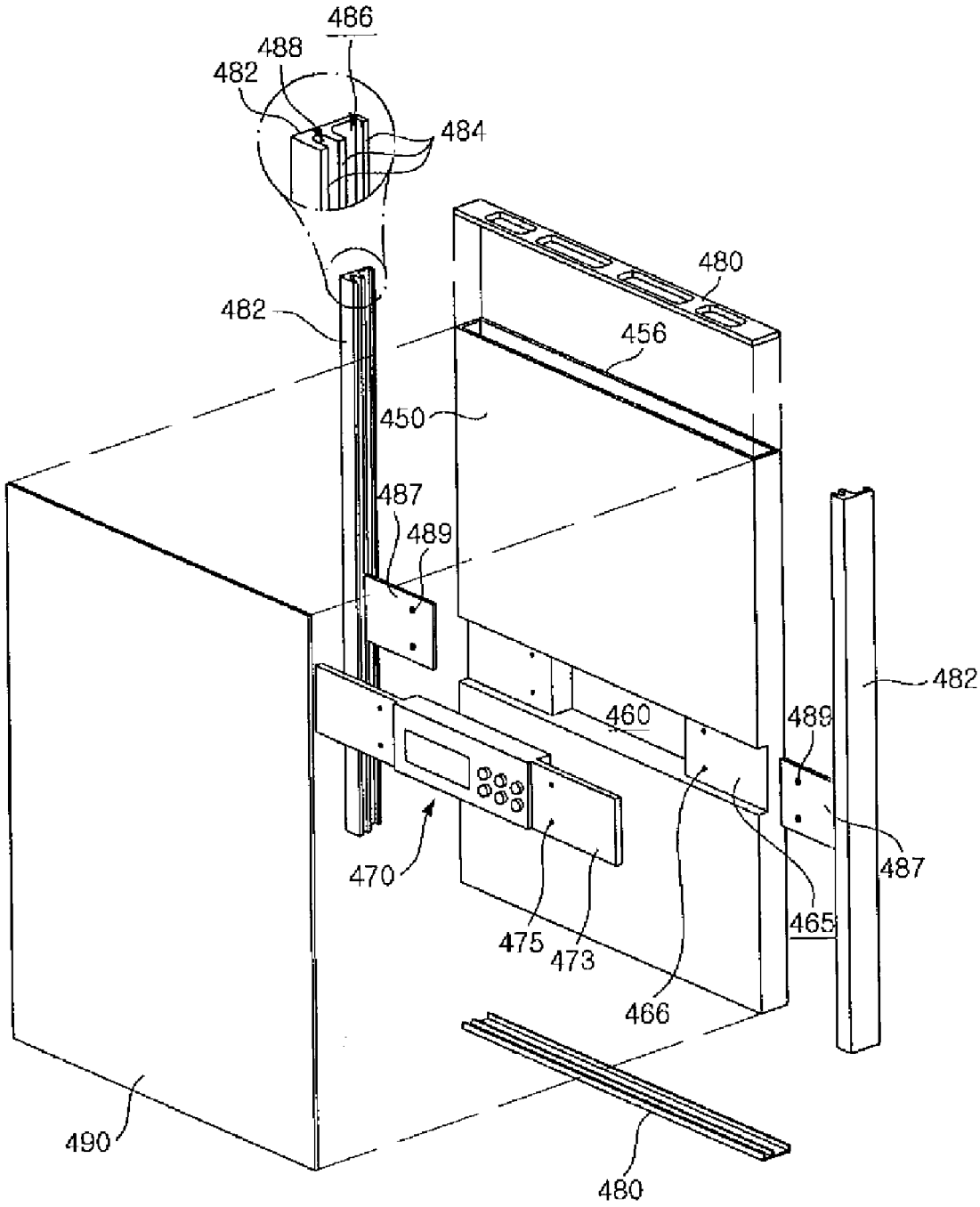

【Figure 13】
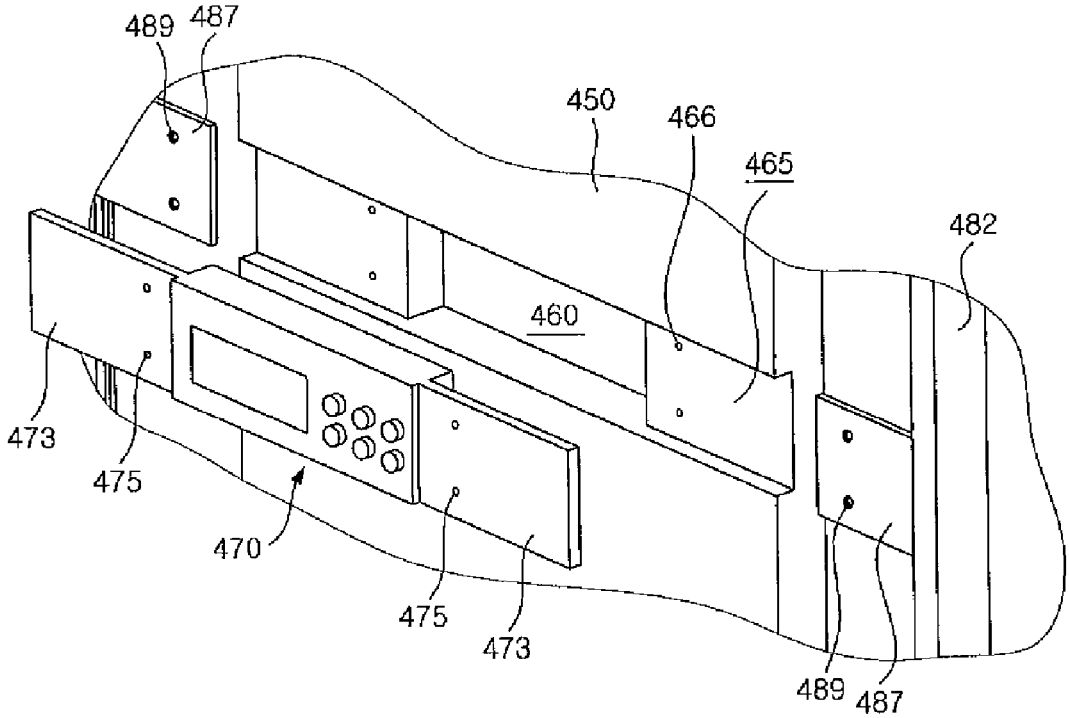

【Figure 14】
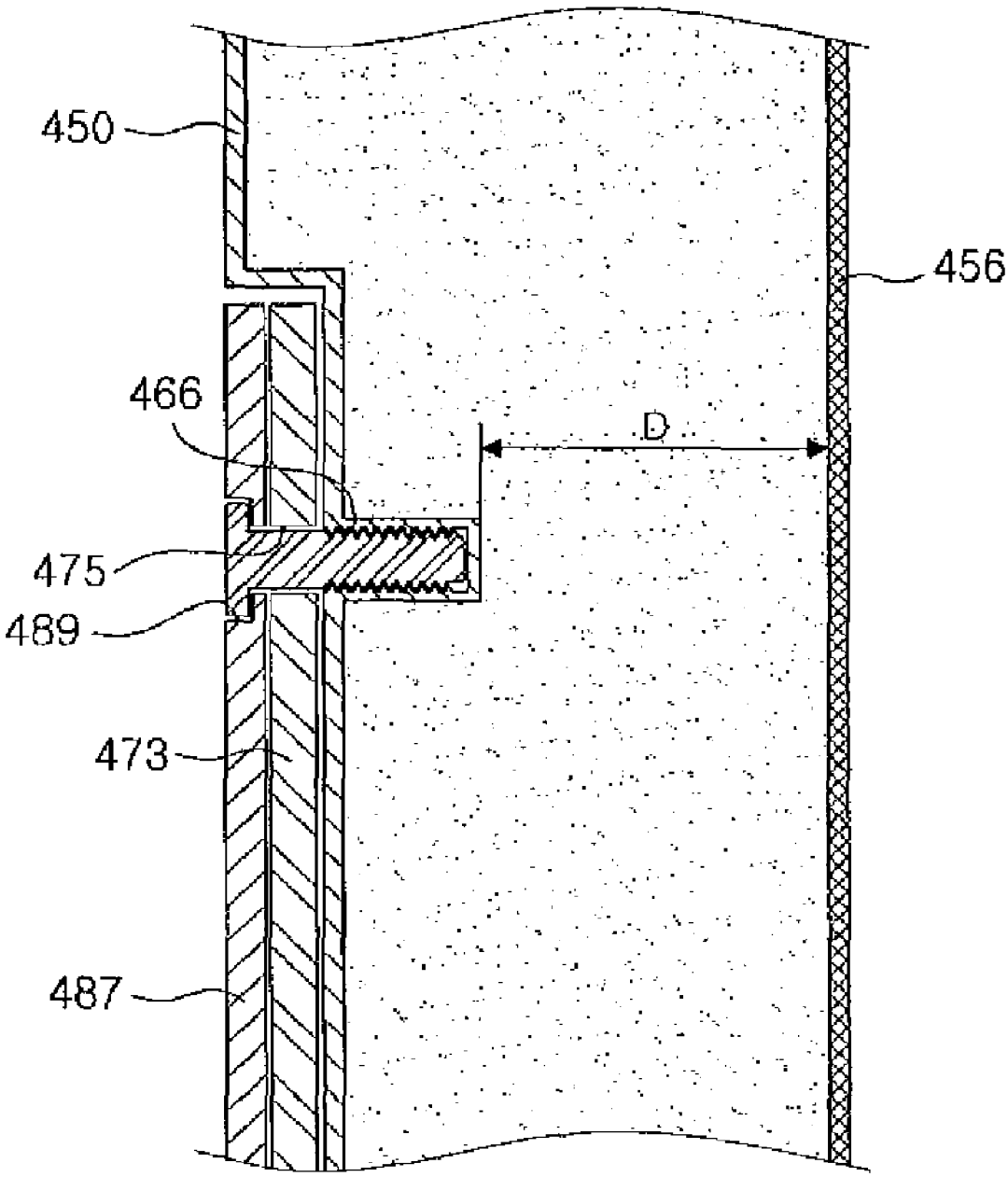

【Figure 15】
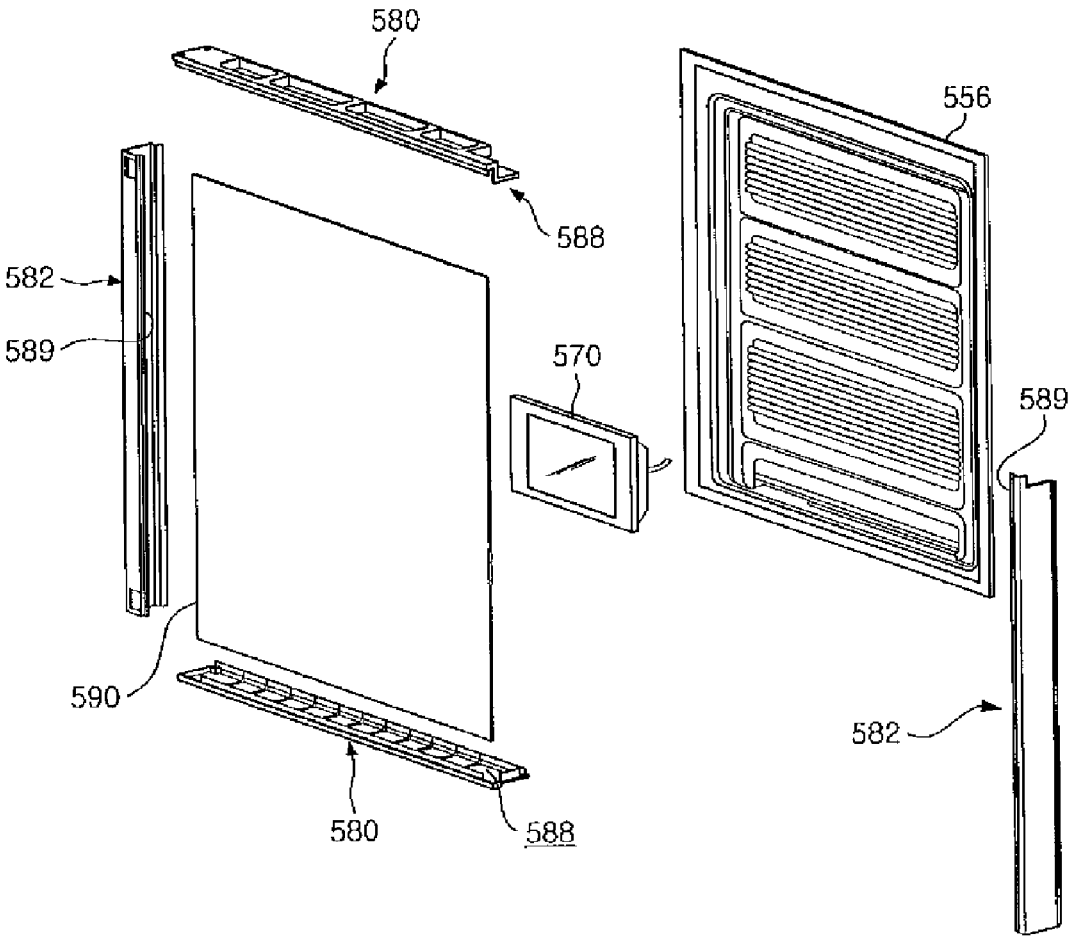

【Figure 16】
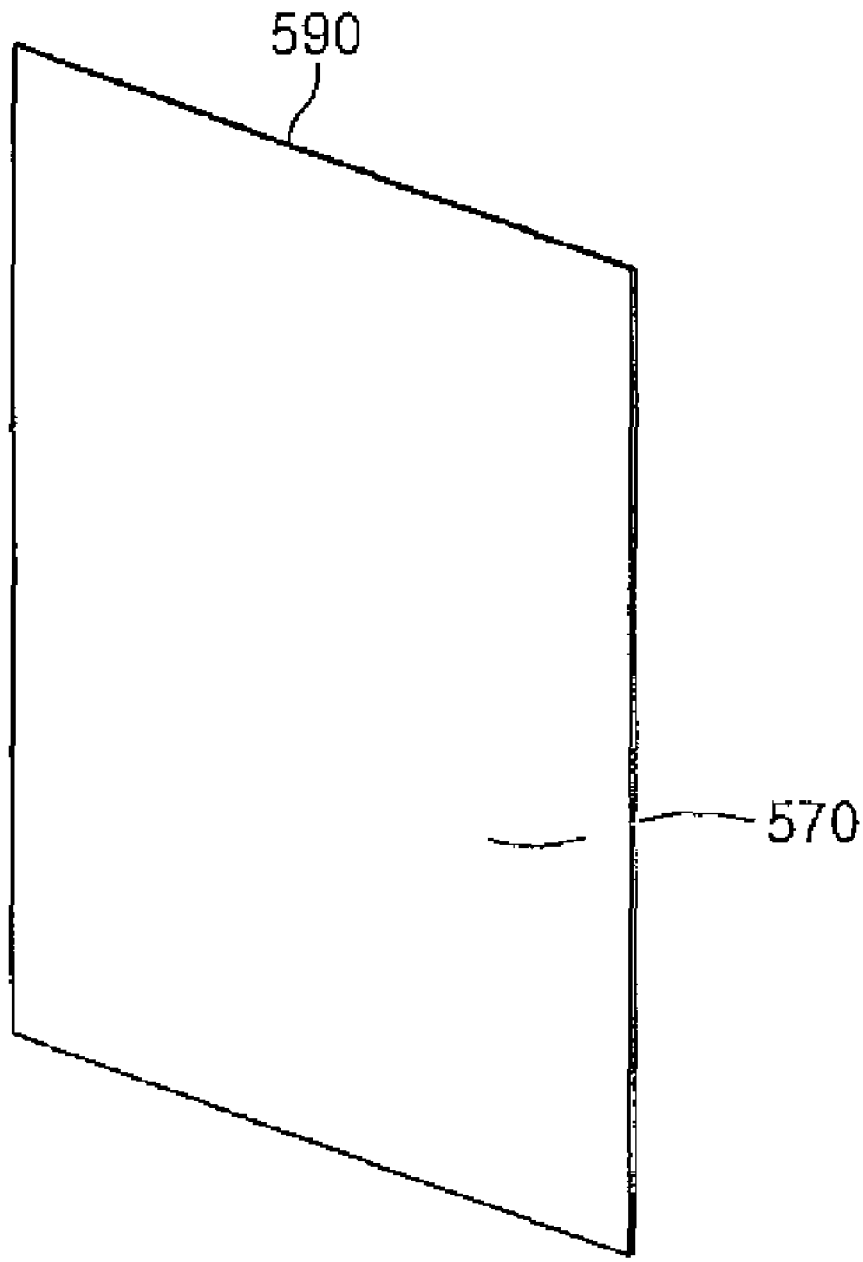

【Figure 17】
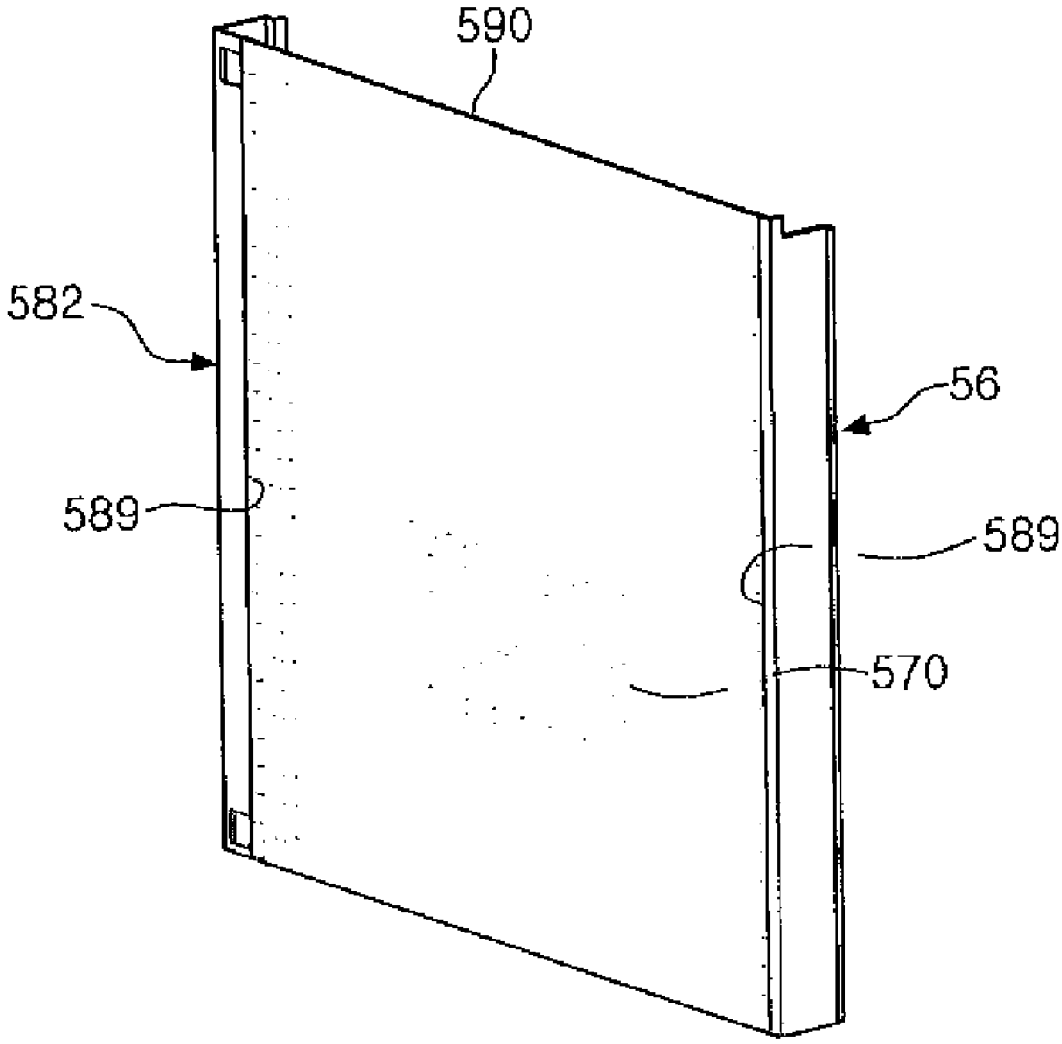

【Figure 18】
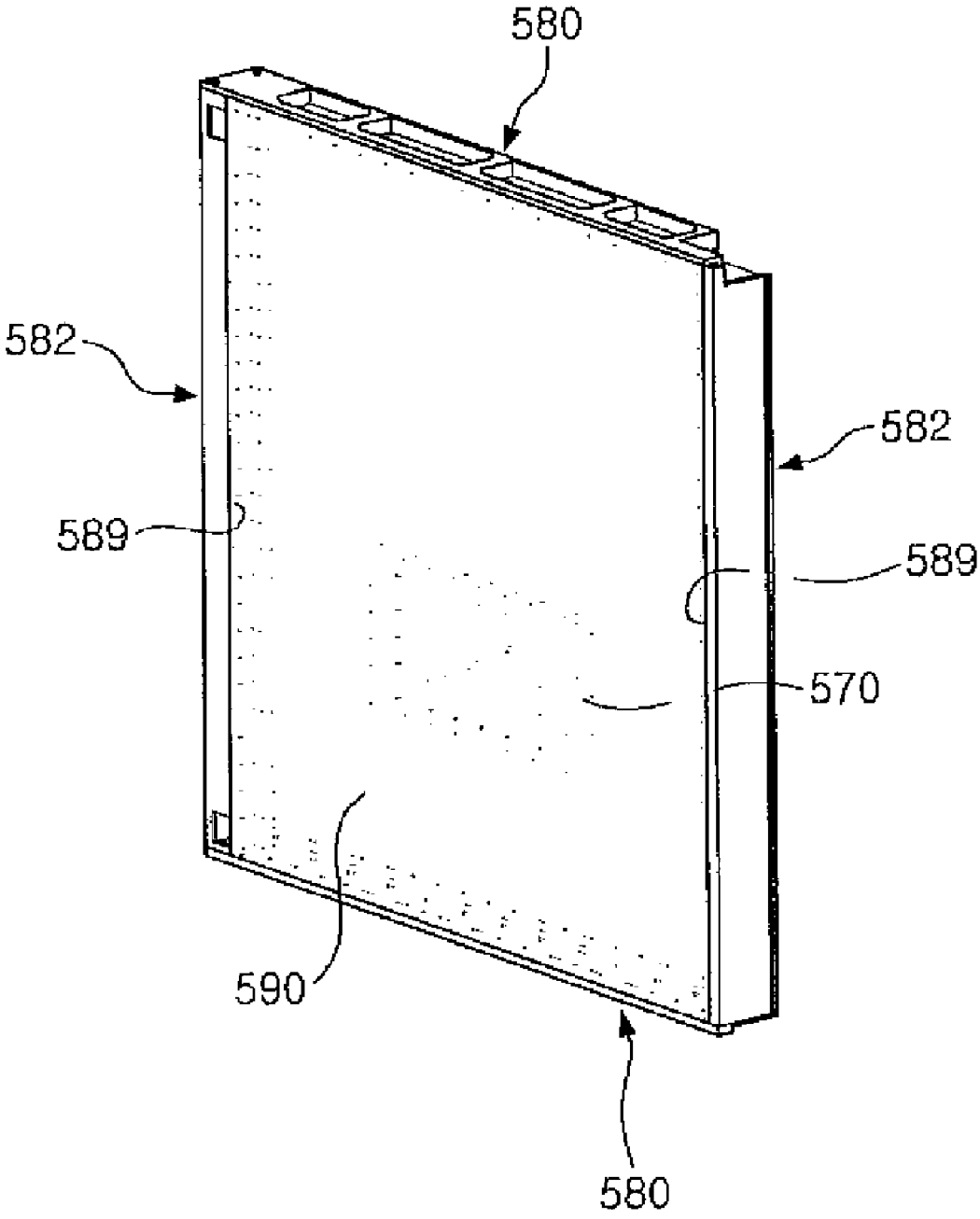

【Figure 19】
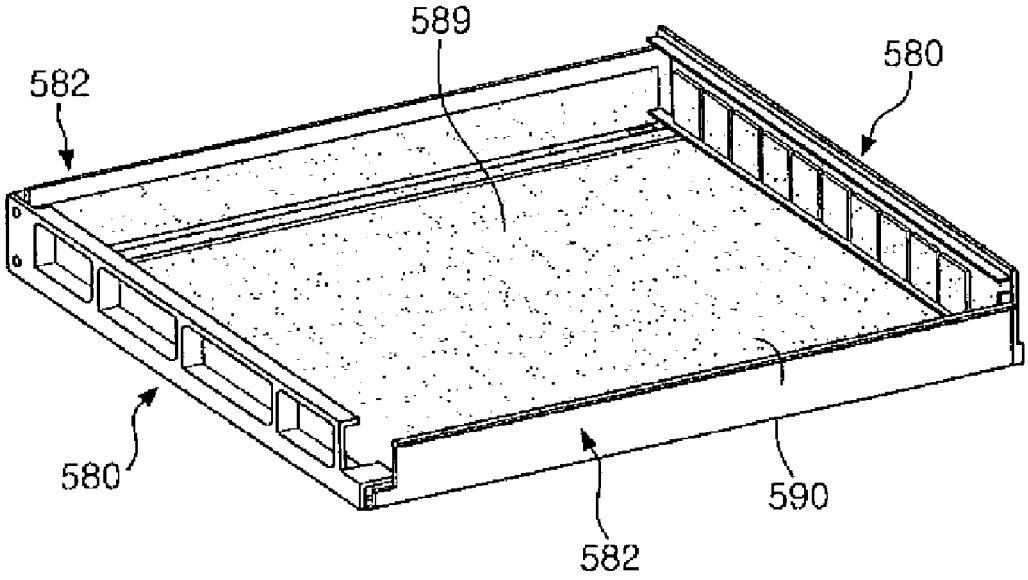

【Figure 20】
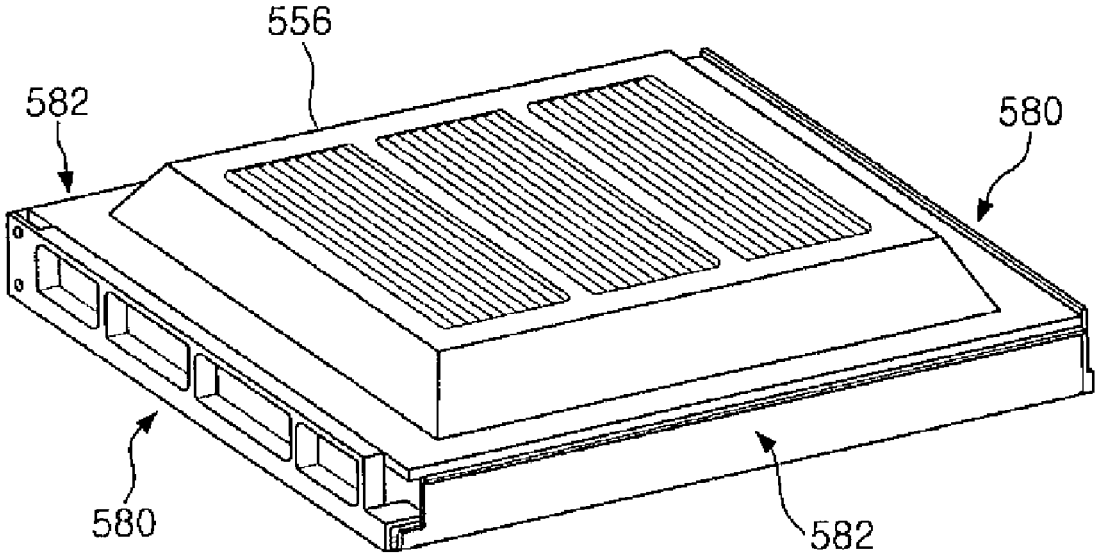

【Figure 21】
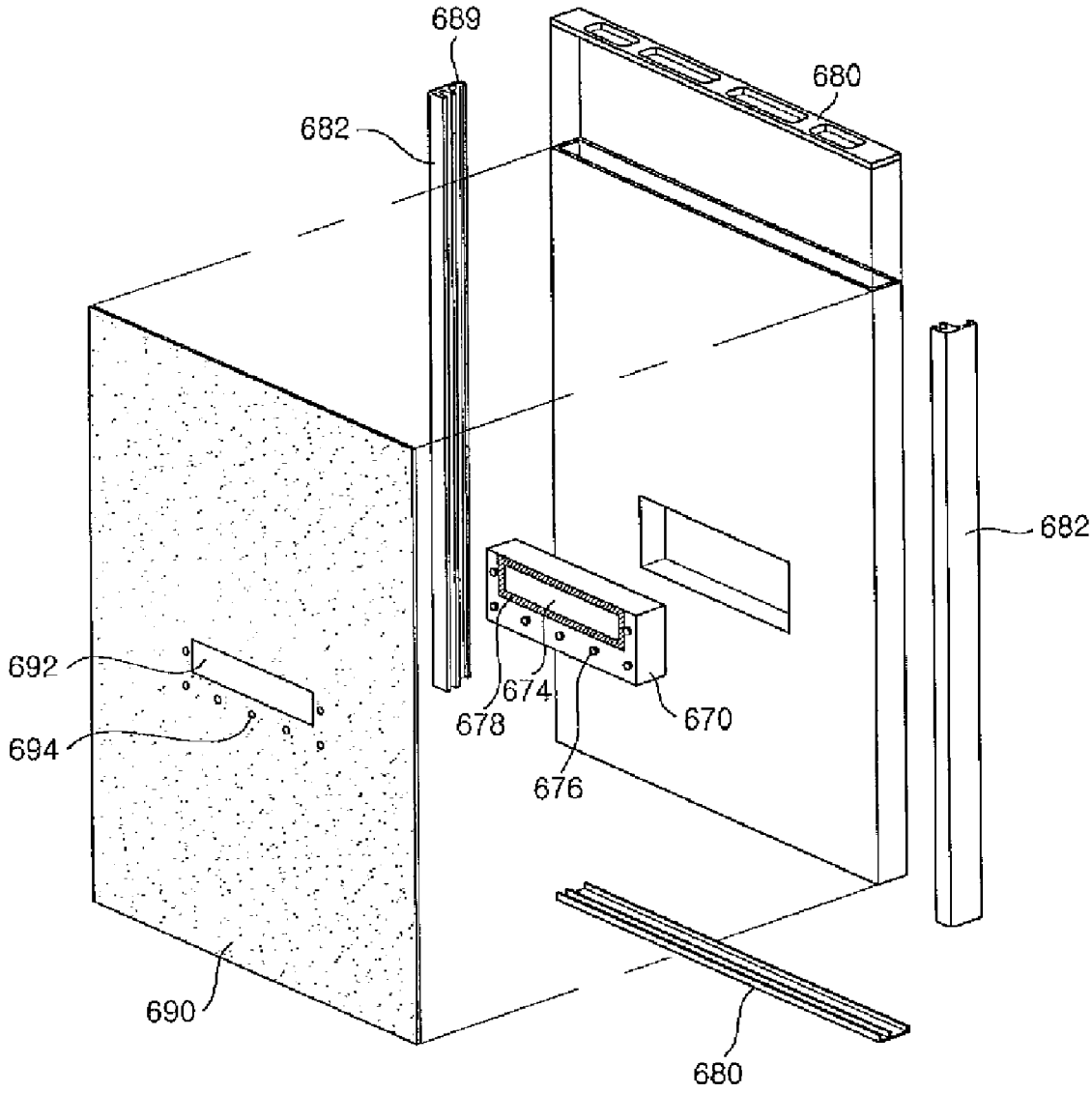

【Figure 22】
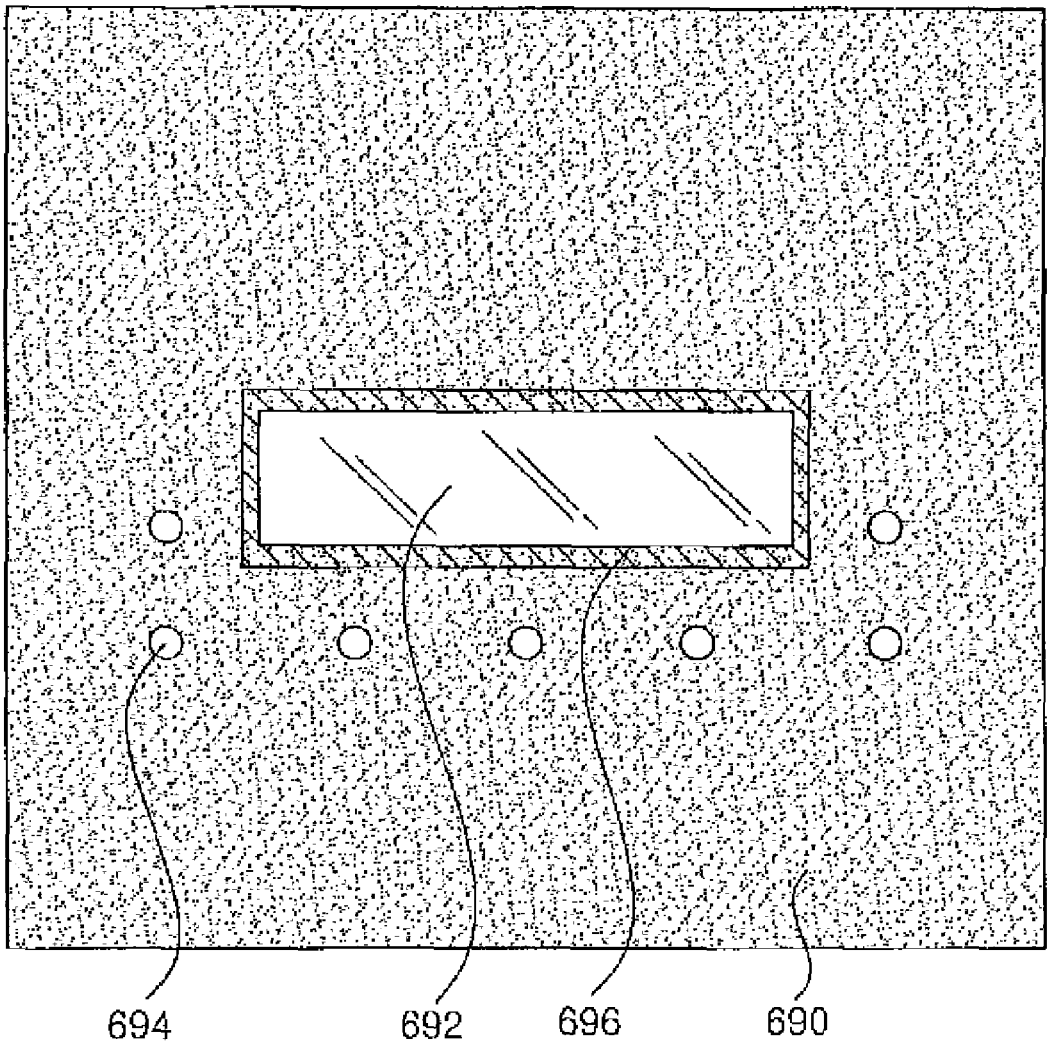

REFRIGERATOR DOOR AND METHOD OF MANUFACTURE THEREOF

TECHNICAL FIELD

The present invention relates to a refrigerator door with a front formed of a single transparent member and a method of manufacturing the same, and more particularly, to a refrigerator door with a front formed of a transparent plate in which a display portion does not protrude and is installed within the transparent plate and a method of manufacturing the same.

BACKGROUND ART

In general, a refrigerator is equipped with a display portion for informing a user of the operating condition of the refrigerator and for controlling the refrigerator according to the information input by the user. In the meantime, recently, an exterior material of glass is used to make an external appearance of a refrigerator be luxurious. However, since such a display portion should be installed, a front of a door cannot be decorated with an exterior material of glass.

FIG. 1 is a front view showing a refrigerator with a conventional display portion installed thereto, and FIG. 2 is an exploded perspective view showing a refrigerator door with the conventional display portion installed thereto.

As shown in the figures, a front external appearance of a door 10 for a refrigerator is defined by an outer door 11. In addition, a door liner 13 defining a rear external appearance of the door 10 is coupled to the rear of the outer door 11. An insulating layer (not shown) is further formed between the outer door 11 and the door liner 13.

In the meantime, a pair of cap decorations 15, which define top and bottom external appearances of the door 10, are coupled to upper and lower ends of the outer door 11 and the door liner 13, respectively.

Each of the cap decorations 15 includes a cap main body 16 extending from side to side and an edge portion 17 bent from a bottom edge of the cap main body 16 and extending by a predetermined length. Thus, the cap main body 16 and the edge portion 17 define a predetermined space within the cap decoration 15 to be opened downward or upward.

A pair of door decorations 21 are respectively coupled to both sides of the outer door 11, door liner 13, and cap decorations 15.

Each of the door decorations 21 is formed to have a side portion 22 vertically extending and a fastening hook 24 bent from a front end of the side portion 22 and extending. The side portions 22 define both side external appearances of the door 10, and the fastening hooks 24 are respectively formed with fastening grooves 24*a* opened in the direction to face each other, into which side edges of a front plate 29 and display assembly, which will be described below, are respectively inserted.

The cap decorations 15 and the door decorations 21 are to each other fixed with a plurality of screws (not shown). That is, the screws that penetrate the cap decorations 15 fix the cap decorations 15 and the door decorations 21 to each other.

In the meantime, the front plate 29 is installed on the front of the outer door 11. The front plate 29, which improves the front external appearance of the door 10, is formed of a coated glass plate. In addition, both side edges of the front plate 29 are inserted into the fastening grooves 24*a* to be fixed. The front plate 29 is made so that its height is lower than that of the outer door 11, thus enabling a display assembly, which will be described below, to be installed to the front plate.

The display assembly 30 is installed to a lower end of the front plate. The display assembly comprises a display section for showing an operating condition of the refrigerator and a control section for controlling an operating condition of the refrigerator.

However, the above prior art has the following problems.

That is, since the display assembly is separately manufactured and installed, there is a problem in that it is impossible to create an external appearance of the display assembly to have integrity with the front plate.

In addition, since the display assembly is installed to protrude in the prior art, it is impossible to create an external appearance of the display assembly to have integrity with the front plate. Further, foreign materials are introduced into the display and control sections of the display assembly, thereby often resulting in the cause of a trouble. Thus, the necessity for a refrigerator with the front formed of a glass becomes a prominent feature.

Meanwhile, in order to manufacture a refrigerator with the front formed of a transparent plate, a display portion should be installed within a front decoration. However, it has been necessary to provide a structure for stably seating the display portion in a correct position of the front decoration.

DISCLOSURE

Technical Problem

Accordingly, the present invention is conceived to solve the aforementioned problems in the prior art. An object of the present invention is to provide a structure of a refrigerator door with a front of a refrigerator formed of a single transparent plate.

Another object of the present invention is to provide a structure of a refrigerator door which is easily cleaned and prevents moisture, dust or the like from being permeated since a display portion of a refrigerator is isolated from the outside.

A further object of the present invention is to provide a structure of a refrigerator door, in which a predetermined space for accommodating a display portion is provided in an additional door main body and the display portion is stably seated in the display accommodating portion.

A still further object of the present invention is to provide a refrigerator door which is configured for its front to be formed of a single transparent member and for the number of its parts to be reduced, and a method of manufacturing the same.

Technical Solution

According to an aspect of the present invention for achieving the objects, there is provided a refrigerator door, comprising an outer door formed to have a display accommodating portion defined by depressing its front by a predetermined size; a display portion inserted into the display accommodating portion and showing and controlling a refrigerator condition; and a front decoration formed of a transparent plate and positioned in a front of the outer door and display portion to define a front of the refrigerator door.

At this time, the front decoration may be formed of a plastic or glass member.

Preferably, the display portion includes a display section for showing an operating condition of a refrigerator and an input section for receiving a user's command, and a rear of the front decoration is colored with a color to be represented, the front decoration having a portion in contacting with the display section to be formed transparent and a portion in contact with the input section to have an input mark printed.

In addition, the present invention may further comprise a door liner provided on a rear of the outer door to provide an insulating layer between the outer door and the door liner and to define a rear of the refrigerator door, a pair of cap decorations provided on upper and lower portions of the outer door and door liner to define top and bottom external appearances of the refrigerator door, and a pair of door decorations coupled to both sides of the outer door and door liner to define both side external appearances of the refrigerator door.

Here, the cap decorations and the door decorations may be formed with fastening grooves, and the front decoration may be fitted into the fastening grooves of the cap and door decorations and supported thereto.

Meanwhile, in the present invention, a side of the display accommodating portion may be stepwise formed to have a seating surface defined, and a rear of the display portion may be formed to have a step corresponding to the display accommodating portion, whereby the rear of the display portion is seated on the seating surface.

At this time, the seating surface may also be provided with a shock absorbing member formed of an elastic material.

In the meantime, the present invention may further comprise an elastic member installed on a lower end of the display accommodating portion and elastically supporting the display portion upward.

At this time, the elastic member may be an elastic rib formed by curvedly bending an elastic material.

In addition, a seating groove in which the elastic rib can be seated may be formed in a bottom surface of the display portion.

Meanwhile, in the present invention, a side of the display accommodating portion may be formed with a guide protrusion and a side of the display portion may be formed with a guide groove for guiding movement of the guide protrusion when the display portion is inserted into the display accommodating portion.

Alternatively, in the present invention, a side of the display portion may be formed with a guide protrusion and a side of the display accommodating portion may be formed with a guide groove for guiding movement of the guide protrusion when the display portion is inserted into the display accommodating portion.

At this time, the guide groove and the guide protrusion may also be provided on each of both sides of the display portion and each of both sides of the display accommodating portion.

In addition, the guide groove may be formed to be curved according to an insertion of the display portion for the guide protrusion to be inserted into the guide groove while the display portion rotates.

Meanwhile, in the present invention, support plates may be formed to extend from both sides of the display portion, and support plate insertion portions may be formed in both sides of the display accommodating portion, the support plate insertion portion being depressed to have a size corresponding to the support plate for the support plate to be seated in the support plate insertion portion, whereby the support plates are fixed to the outer door and thus the display portion is fixed to the display insertion portion.

At this time, the present invention may further comprise a door liner provided on a rear of the outer door to provide an insulating layer between the outer door and the door liner and to define a rear of the refrigerator door, a pair of cap decorations provided on upper and lower portions of the outer door and door liner to define top and bottom external appearances of the refrigerator door, and a pair of door decorations coupled to both sides of the outer door, door liner and cap decorations to define both side external appearances of the refrigerator door, wherein fixing plates may be respectively formed on insides of the door decorations to be provided on the support plates and to be fixed to the outer door through the support plates.

In addition, a screw fixing portion in the front of the fixing plates may have a screw hole formed to be depressed by a predetermined size so that a head of a screw is seated therein and thus does not protrude from the front surface thereof.

In the meantime, the present invention provides a refrigerator door, comprising: a front decoration defining a front external appearance of the refrigerator door; a door liner provided on a rear of the front decoration to define a rear external appearance of the refrigerator door; door decorations coupled to both sides of the front decoration to define both side external appearances of the refrigerator door; cap decorations coupled to upper and lower ends of the front decoration to define top and bottom external appearances of the refrigerator door; and a display portion installed to a rear surface of the front decoration.

At this time, the display portion may include a display section for showing an operating condition of a refrigerator and an input section for receiving a user's command, and a rear of the front decoration may be colored with a color to be represented, the front decoration having a portion in contacting with the display section to be formed transparent and a portion in contact with the input section to have an input mark printed.

In addition, both side ends of the front decoration may be respectively inserted into fastening grooves provided in front ends of the door decorations, and upper and lower ends of the front decoration may be inserted into and supported to coupling grooves provided in edges of the cap decorations.

In the meantime, the present invention provides a method of manufacturing a refrigerator door, comprising steps of: installing a display portion to a rear surface of a front decoration, the front decoration defining a front external appearance of the refrigerator door; coupling door decorations to both side ends of the front decoration, the door decorations defining both side external appearances of the refrigerator door; coupling cap decorations to upper and lower ends of the front decoration to which the door decorations are coupled, the cap decorations defining top and bottom external appearances of the refrigerator door; injecting foam liquid into a space defined by the front decoration, the door decorations and the cap decorations; and coupling a door liner to a rear of the front decoration.

In the meantime, the display portion of the present invention may include a display section for showing an operating condition with a peripheral portion colored with a color to be represented, and a portion of the front decoration corresponding to the display section is transparent, a rear surface of the front decoration including a portion partially overlapping with the colored portion of the display section being colored with the same color as the peripheral portion of the display portion.

At this time, the color with which the display section is colored is identical to that with which the front decoration is colored.

Advantageous Effects

According to the present invention so described in detail above, the following advantages can be expected.

That is, since a front of a display portion of a refrigerator door is formed of a single transparent plate, there is an advantage in that the refrigerator appears to be generally unified and clear.

Further, since the refrigerator display portion according to the present invention is isolated from the outside and installed on the rear of a front decoration, there is no concern about permeation of moisture, dust or the like. Thus, there is an advantage in that it is possible to freely clean with a damp cloth or the like.

Also, in a case where the front decoration is formed of a plastic member, the member is light, which advantageously makes the assembling process simplified. In addition, there is few concern of the breakage, thereby advantageously increasing the working efficiency.

Further, in the refrigerator door according to the present invention, the coupling of the display portion and a display accommodating portion is performed by means of their edge portions formed in two steps, so that it is advantageous to stably couple the display portion to the display accommodating portion.

Also, according to the present invention, since a shock absorbing member formed of an elastic material is installed between the display portion and the display accommodating portion, it is advantageous to stably support the display portion and to absorb the shocks applied to the display portion during transportation or use of the refrigerator.

In addition, according to the refrigerator door of the present invention, the display accommodating portion may be formed to be larger than the display portion, whereby it is possible to easily perform a process of coupling the display accommodating portion and the display portion. Further, since elastic ribs push the display portion upward, it is advantageous to prevent the display portion from floating after the coupling.

Also, according to the present invention, the elastic ribs make a snapping sound when the display portion is inserted into the display accommodating portion. Thus, there is an advantage in that a manufacturer can confirm the complete coupling of the display portion by hearing the snapping sound.

In addition, in the refrigerator door according to the present invention, since the display portion is inserted along guide grooves when inserted into the display accommodating portion, there is an advantage in that the insertion process is easy.

Also, according to the present invention, since the display portion is fixedly supported after inserted into the display accommodating portion, there is an advantage in that there is no concern about the movement of the coupling position of the display portion during the use of the refrigerator.

In addition, the refrigerator door according to the present invention is configured so that the display portion manufactured in a single body is fixed to the display accommodating portion, thereby making the fastening structure thereof simple. Therefore, there is an advantage in that there is little concern about floating and removal of the display device.

Meanwhile, the refrigerator door according to the present invention comprises a front decoration, a door liner, door decorations and cap decorations defining the front, rear, both sides and top and bottom external appearances of the door, respectively. Therefore, the number of parts of the door is reduced, whereby it is possible to manufacture the door with low costs.

In addition, in the refrigerator door according to the present invention, a peripheral portion of a display section of the display portion is colored with the same color as the front decoration. Thus, although the peripheral portion of the display section and a transparent portion of the front decoration are not correctly aligned with each other and some misalignment therebetween occurs, it cannot be observed from the outside. Thus, in a case where such a gap is a fine one which does not raise a problem in function, it is advantageous to reduce the inferiority of products due to the gap.

DESCRIPTION OF DRAWINGS

FIG. 1 is a front view showing a conventional refrigerator;

FIG. 2 is an exploded perspective view showing a conventional refrigerator door;

FIG. 3 is an exploded perspective view showing that a display portion is installed to a refrigerator door according to a preferred embodiment of the present invention;

FIG. 4 is an exploded perspective view showing a refrigerator door according to a first embodiment of the present invention;

FIG. 5 is a detailed sectional view showing that a display portion is mounted to the refrigerator door according to the first embodiment of the present invention;

FIG. 6 is an exploded perspective view showing a refrigerator door in which a second embodiment of the present invention is employed;

FIG. 7 is a side sectional view showing that a display portion of the second embodiment of the present invention is coupled to the refrigerator door;

FIG. 8 is a side sectional view showing that the display portion of the second embodiment of the present invention is coupled to the refrigerator door;

FIG. 9 is an exploded perspective view showing a refrigerator door in which a third embodiment of the present invention is employed;

FIG. 10 is an enlarged perspective view showing a display portion and a display accommodating portion of the third embodiment of the present invention;

FIG. 11 is an enlarged perspective view showing an embodiment in which installation positions of guide grooves and guide protrusions are modified from the third embodiment of the present invention;

FIG. 12 is an exploded perspective view showing a refrigerator door according to a fourth embodiment of the present invention;

FIG. 13 is an enlarged perspective view showing a display portion, a display accommodating portion and a door decoration of the fourth embodiment of the present invention;

FIG. 14 is a sectional view showing that a refrigerator main body and the display portion are coupled through support and fixing plates according to the fourth embodiment of the present invention;

FIG. 15 is an exploded perspective view showing a refrigerator door according to a fifth embodiment of the present invention;

FIGS. 16 to 20 are views showing a process of manufacturing the refrigerator door according to the fifth embodiment of the present invention;

FIG. 21 is a perspective view showing a refrigerator door in which a sixth embodiment of the present invention is employed; and FIG. 22 is a front view showing that a display device according to the sixth embodiment of the present invention is mounted to the refrigerator door.

BEST MODE

FIG. 3 is an exploded perspective view showing that a display portion is installed to a refrigerator door according to a preferred embodiment of the present invention.

As shown in the figure, the preferred embodiment according to the present invention comprises an outer door 50 defining the front of the door, wherein extending portions 52 are formed on both sides of the outer door 50 to be bent and extend by a predetermined length. The outer door 50 is formed with a display accommodating portion 60 which is defined by depressing a predetermined space, wherein the display accommodating portion 60 is a portion into which a display portion 70 which will be described below is installed.

A door liner 56 defining the rear of the refrigerator door is coupled to the rear of the outer door 50. The door liner 56 is coupled to the extending portions 52 of the outer door 50, thus defining a predetermined space between the outer door 50 and the door liner 56.

An insulating layer (not shown) is formed in a space between the outer door 50 and the door liner 56, wherein the insulating layer is formed by allowing foam liquid such as foam resin to foam in the space.

A pair of cap decorations 80 defining top and bottom external appearances of the door are fitted to upper and lower ends of the assembly of the outer door 50 and door liner 56, respectively. The cap decoration 80 includes a decoration main body 60 formed to extend from side to side and ribs 84 formed to be bent by a predetermined length from edges of the decoration main body. As enlargedly shown in FIG. 3, it is preferred that three of the ribs 84 be formed and thus two grooves be defined between the respective ribs 84. Among the grooves, the inside groove 86 is a portion into which the assembly of the aforementioned outer door 50 and door liner 56 is fitted, and the groove formed in the outside (hereinafter, referred to as 'fastening groove') is a portion into which a front decoration 90, which will be describe below, is fitted.

Door decorations 82 are fitted into and installed to both left and right sides of the assembly of the outer door 50 and door liner 56 so that both ends of the door decorations 82 face those of the cap decorations 80 at both left and right sides of the cap decorations 80. The door decoration 82 is formed to have the same cross section as the cap decoration 80 in principle. Thus, it is preferred that a coupling groove to which a front decoration 90 is coupled be formed in the front of the door decoration 82.

As described above, the door liner 56 is coupled to the outer door 50 and the cap decorations 80 and the door decorations 82 which support the door liner 56 and outer door 50 are coupled, thereby defining a door body (hereinafter, referred to as 'door assembly').

The display portion 70 is installed to the display accommodating portion 60 which is formed in the front of the door assembly, wherein the display portion 70 comprises a display section 74 for informing a user of an operating condition of the refrigerator and a control section 76 for controlling the operating condition of the refrigerator and is formed to have a size corresponding to the display accommodating portion 60.

After the display portion 70 is installed to the door assembly, the front decoration 90 is installed on the front thereof. The front decoration 90 is made of a sheet of transparent plate and is installed by respectively fitting an edge of the front decoration 90 into the coupling grooves and the fastening grooves 88 formed in the cap decorations 80 and the door decorations 82. The rear surface of the front decoration 90 is colored with a color for representing the external appearance of the refrigerator, and a transparent window 92 for making it possible to observe the display portion 70 is form in the portion in contact with the display portion 70. In addition, an input position mark for enabling a user to recognize an input position is printed on a position corresponding to an input section of the display portion 70.

In the meantime, the front decoration 90 may be made of a plastic material, preferably, may be made of a sheet of plastic material and have the rear surface painted with a color to be represented.

Hereinafter, the operation of the refrigerator door according to the present invention will be described in detail.

The user, who intends to control the refrigerator according to the preferred embodiment of the present invention, pushes the input section printed on the front decoration 90 by hand. At this time, the display portion 70 positioned in the rear of the front decoration 90 detects a magnetic field or body temperature generated by the user's hand, converts it into an input signal, and then, controls the operating condition of the refrigerator by the input signal.

Meanwhile, since there is no concern about permeation of water through the display portion 70 when the user intends to clean the exterior of the refrigerator, it is possible to wipe the front of the door with a damp cloth or the like.

Mode for Invention

First Embodiment

Hereinafter, a first embodiment of the present invention as described above will be described in detail with reference to the accompanying drawings.

FIG. 4 is an exploded perspective view showing a refrigerator door according to the first embodiment of the present invention, and FIG. 5 is a detailed sectional view showing that a display portion is mounted to the refrigerator door according to the first embodiment of the present invention.

As shown in the figures, the first embodiment of the present invention has the same configuration as the preferred embodiment of the present invention except for the configuration of a display portion 170 and a display accommodating portion 160. The display accommodating portion 160 which is depressed and formed in an outer door 150 is formed so that an inside edge of the display accommodating portion 160 is formed in multiple steps. For convenience of explanation, the first embodiment of the present invention will be described in focus on the embodiment in which the inside edge of the display accommodating portion 160 is formed in two steps. As shown in FIG. 5, the two-stepwise portion defines a seating space 162 around the inside edge of the display accommodating portion 160, and the seating space 162 is formed with a seating surface 164 having steps.

The display portion 170 is inserted into the display accommodating portion 160. The display portion 170 is formed in two steps corresponding to the display accommodating portion 160 so that the rear of the display portion 170 is correctly seated in the seating surface 164 defined in the display accommodating portion 160.

Although the display portion 170 may be directly inserted into the display accommodating portion 160 as described above, it is preferred that a shock absorbing member 172 be installed between the display accommodating portion 160 and the display portion 170.

It is preferred that an elastic member installed to be fixed to the seating surface 164 be used as the shock absorbing member 172. Also preferably, the shock absorbing member 172 provides a certain elastic force when the display portion 170 is fitted, thereby absorbing shocks applied to the display portion 170 and supporting it not to move. In the meantime, both sides of the front of the display portion 170 are temporarily attached to a front decoration 190 with a double sided tape 175 or the like, and then, they are assembled.

Hereinafter, the operation of the refrigerator door according to the present invention will be described in detail according to assembling order and use order thereof.

In order to assemble the refrigerator door according to the first embodiment of the present invention, foam liquid is first applied to the outer door 150, and then a door liner 156 is coupled thereto before the foam liquid foams. Then, cap decorations 180 are coupled to the upper and lower ends of the outer door 150 in order for the foam liquid not to flow out, and then, the foam liquid is caused to foam.

Thereafter, the front decoration 190 and the display portion 170 are fitted to the front of the outer door 150. At this time, the display portion 170 is temporarily attached to the rear of the front decoration 190 with the double sided tape 175 or the like. The display portion 170 temporarily coupled to the front decoration 190 is inserted together with the front decoration 190 into the front of the outer door 150.

Then, door decorations 182 are coupled to the left and right sides of the outer door 150, thereby completing the door assembling.

The user, who intends to use the assembled refrigerator door, can read the contents displayed on the display portion 170 through a transparent window 192 which is formed to be transparent in the front decoration 190, and input input signals by touching a button portion (not shown) printed on the front decoration 190 by hand.

Second Embodiment

Hereinafter, a second embodiment of the present invention will be described in detail with reference to the accompanying drawings.

FIG. 6 is an exploded perspective view showing a refrigerator door in which the second embodiment of the present invention is employed, FIG. 7 is a side sectional view showing that a display portion of the second embodiment of the present invention is coupled to the refrigerator door, and FIG. 8 is a side sectional view showing that the display portion of the second embodiment of the present invention is coupled to the refrigerator door.

The second embodiment of the present invention has the same configuration as the preferred embodiment of the present invention except for a display accommodating portion 260 and a display portion 270.

The display portion 270 is installed to the display accommodating portion 260 which is formed in the front of an outer door 250, wherein the display portion 270 and the display accommodating portion 260 are formed so that a predetermined reserved space is formed therebetween. It is for the purpose of enabling an elastic member, which will be described below, to be provided in the reserved space. A door liner 256 defining the rear of the refrigerator door is coupled to the rear of the outer door 250.

An elastic member for elastically supporting the display portion 270 upward, which will be described below, is installed to a lower end of the display accommodating portion 260. Preferably, as shown in FIG. 7, elastic ribs 262 each of which is formed by curvedly bending an elastic material and installed are used as the elastic member. At this time, there may be formed one or more of the elastic ribs 262.

In the meantime, when the elastic ribs 262 are installed to the display accommodating portion 260, it is preferred that a seating groove 264 in which the elastic ribs 262 can be seated be formed in the bottom surface of the display portion 270 in the shape corresponding to bents of the elastic ribs 262.

Hereinafter, the refrigerator door according to the present invention will be described in detail through an installation process of the display portion 270.

The manufacturer, who intends to assemble the refrigerator display according to the present invention, first couples the display portion 270 to a front decoration 290. Preferably, the front decoration 290 and the display portion 270 are temporarily attached to each other with a double sided tape 275. At this time, it is important to couple a display section 274 of the display portion 270 and a transparent window 292 of the front decoration 290 to be correctly aligned with each other.

After attaching the display portion 270 to the front decoration 290, the manufacturer, as shown in FIG. 7, inserts the upper end of the front decoration 290 into a cap decoration 280 provided in an upper end of the outer door 250 and then inserts the display portion 270 into the display accommodating portion 260 by rotating the front decoration 290.

When the display portion 270 is inserted into the display accommodating portion 260, the elastic ribs 262 are compressed which are installed on the lower end of the display accommodating portion 260. The elastic ribs 262 push the display portion 270 upward when compressed. Then, when the display portion 270 is completely inserted, the bents of the elastic ribs 262 are seated in the seating groove 264 provided in the bottom surface of the display portion 270. At this time, the elastic ribs 262 make a snapping sound at the same time when they are seated, so that the manufacturer can confirm the complete insertion of the display portion 270 by hearing the snapping sound.

After the complete insertion of the display portion 270, the assembling of the refrigerator door is completed by installing a pair of door decorations 282 to the left and right sides of the door main body and front decoration 290.

Third Embodiment

Hereinafter, a third embodiment of the present invention will be described in detail with reference to the accompanying drawings.

FIG. 9 is an exploded perspective view showing a refrigerator door in which the third embodiment of the present invention is employed, FIG. 10 is an enlarged perspective view showing a display portion and a display accommodating portion of the third embodiment of the present invention, and FIG. 11 is an enlarged perspective view showing an embodiment in which installation positions of guide grooves and guide protrusions are modified from the third embodiment of the present invention.

In order to clearly show the configuration of the display portion and display accommodating portion, a front decoration attached to the front of the display portion is omitted in FIGS. 10 and 11.

As shown in the figures, the third embodiment of the present invention comprises an outer door 350 defining the front of the door, wherein the outer door 350 is formed with a display accommodating portion 360 which is defined by depressing a predetermined space. The display accommodating portion 360 is a portion into which a display portion 370 which will be described below is installed. Preferably, the display accommodating portion 360 is formed to be somewhat larger than the display portion 370 which will be described below and thus to be easily inserted into the display portion 370.

A guide protrusion 362 is formed on one or both sides of the display accommodating portion 360. The guide protrusion 362 is inserted into a guide groove 364, which will be described below, thus guiding the insertion of the display portion 370 and supporting it.

Hereinafter, a case where the guide protrusion 362 is formed on each of both the sides of the display accommodating portion 360 will be described as an example.

The display accommodating portion 360 is mounted with the display portion 370. The display portion 370 comprises a display section 374 for informing a user of an operating condition of the refrigerator and a control section 376 for controlling the operating condition of the refrigerator and is formed in a shape corresponding to the display accommodating portion 360.

The guide grooves 364 are formed in both the sides of the display portion 370. The guide grooves 364 are formed in correspondence to the moving direction in which the display portion 370 is inserted, and guide the insertion of the display portion 370 while the guide protrusions 362 are inserted into the guide grooves 364. Therefore, in a case where the display portion 370, which is fixed to the front decoration 390, is fitted together with the front decoration 390 into the display accommodating portion 360, it is preferred that each of the guide grooves 364 is shaped in a circular arc so that the center of the circular arc corresponds to a cap decoration 380 provided in the upper end of the outer door 350.

Then, a trailing end of the guide groove 364 is formed in correspondence with the position in which the display portion 370 is finally fixed, thereby supporting the display portion 370 after the display portion 370 is completely inserted.

The front decoration 390 is installed on the front of the outer door 350. At this time, the display portion 370 is inserted into the display accommodating portion 360 with the display portion 370 attached to the front decoration 390 with a double sided tape 375, which is for the purpose of correctly aligning the display section 374 and a transparent window 392 transparently formed in the front decoration 390 with each other.

In the meantime, in the third embodiment of the present invention, the positions in which the guide protrusions and the guide grooves are formed may be changed. That is, as shown in FIG. 11, guide grooves 364' may be formed in both sides of the display accommodating portion 360 and guide protrusions 362' may be formed on the display portion 370.

Even though the positions of the guide protrusions and grooves 362' and 364' are changed, their respective operations are identical to those of the preferred embodiment of the present invention.

Hereinafter, the operation of the refrigerator door according to the third embodiment of the present invention will be described in detail through an installation process of the display portion 370.

The user, who intends to assemble the refrigerator according to the third embodiment of the present invention, first couples the display portion 370 to the front decoration 390. Preferably, the front decoration 390 and the display portion 370 are temporarily attached to each other with the double sided tape 375. At this time, it is important to couple a display section 374 of the display portion 370 and the transparent window 392 of the front decoration 390 to be correctly aligned with each other.

After attaching the display portion 270 to the front decoration 290, the user fits the guide protrusions 362 provided on both the sides of the display accommodating portion 360 into the guide grooves 364 provided in the display portion 370. At this time, it is preferred as described above that the display accommodating portion 360 be formed to be larger than the display portion 370 and thus to correspondence the insertion of the display portion 370.

After the guide protrusions 362 are inserted into the guide grooves 364, the user slowly pushes the front decoration 390 and thus completely inserts the display portion 370 into the display accommodating portion 360.

After the complete insertion of the display portion 370, the assembling of the refrigerator door is completed by installing a pair of door decorations 382 to the left and right sides of the door main body and front decoration 390.

Fourth Embodiment

Hereinafter, a fourth embodiment of the present invention will be described in detail with reference to the accompanying drawings.

FIG. 12 is an exploded perspective view showing a refrigerator door according to the fourth embodiment of the present invention, FIG. 13 is an enlarged perspective view showing a display portion, a display accommodating portion and a door decoration of the fourth embodiment of the present invention, and FIG. 14 is a sectional view showing that a refrigerator main body and the display portion are coupled through support and fixing plates according to the fourth embodiment of the present invention.

As shown in the figures, the fourth embodiment of the present invention has the same configuration as the preferred embodiment of the present invention except for a display accommodating portion and a display portion and door decoration.

As shown in FIG. 13, support plate insertion portions 465, into which support plates 473 which will be described below are inserted, are formed to be depressed shallower than a display accommodating portion 460 and to extend from both sides of the display accommodating portion 460 of the fourth embodiment of the present invention to both sides of a door main body, respectively.

In the meantime, the support plate insertion portions 465 are formed with fastening holes 466 to which screws can be fastened.

In addition, cap decorations 480 and door decorations 482 are respectively fitted to upper and lower ends and both sides of the assembly of an outer door 450 and door liner 456. Each of the cap decorations 480 and door decorations 482 comprises a decoration main body 482 extending from side to side and ribs 484 formed to be bent by a predetermined length from edges of the decoration main body. As enlargedly shown in FIG. 12, it is preferred that three of the ribs 484 be formed and thus two grooves be defined between the respective ribs 484. Among the grooves, the inside groove 486 is a portion to which the assembly of the aforementioned outer door 450 and door liner 456 is fitted, and a fastening groove 488 is a portion into which a front decoration 490, which will be describe below, is fitted.

In the meantime, the intermediate rib 484 of the door decorations 482 includes a fixing plate 487 which is formed by extending a portion of the intermediate rib 484. It is preferred that as shown in FIGS. 12 and 13, each fixing plate 487 be formed at the position corresponding to the support plate 473 of the display portion 470 to have a width and length corresponding thereto.

When the door decorations 482 are coupled after the display portion 470 is fitted into the display accommodating portion 460, the fixing plates 487 are positioned on the support plates 473.

Then, the fixing plates 487 are formed with screw fixing holes 489 corresponding to the fastening holes 466 and through-holes 475 which will be described below. The screw fixing hole 489 is a portion which is penetrated by a screw, which then penetrates the through-hole 475 which will be described below and is fastened to the fastening hole 466.

In addition, the front surface of each screw fixing hole 489 is formed by depressing a predetermined area with a predetermined depth, which is for the purpose of allowing a head of the fastened screw not to protrude from the front surface of the fixing plate 487.

As shown in FIG. 13, the support plates 473 are formed to extend outward from both the sides of the display portion 470 by a predetermined length, and formed with the through-holes 475 at positions corresponding to the fastening holes 466 so that the screws penetrating the through-holes 475 are fastened to the fastening holes 466. After fastening the display portion 470, a minimum thickness D of the insulating layer is as shown in FIG. 14.

Hereinafter, the operation of the refrigerator door according to the present invention will be described in detail according to assembling order.

In order to assemble the refrigerator door according to the fourth embodiment of the present invention, the display portion 470 is first fitted into the display accommodating portion 460 formed in the front of the outer door 450. After the display portion 470 is brought into close contact with and fitted into the display accommodating portion 460, the door decorations 482 are coupled thereto. The door decorations 482 are coupled to both sides of the outer door 450. At this time, the fixing plates 487 formed on the door decorations 482 are positioned on the support plates 473 of the display portion 470. Thereafter, screws are fitted through the screw fixing holes 489 formed in the fixing plates 487, pass through the through-holes 475 of the support plates 473, and then are fastened to the fastening holes 466 of the outer door 450.

After the display portion 470 is fitted into the display accommodating portion 460, the front decoration 490 is coupled to the front thereof.

Fifth Embodiment

Hereinafter, a fifth embodiment of the present invention will be described in detail with reference to the accompanying drawings.

FIG. 15 is an exploded perspective view showing a refrigerator door according to the fifth embodiment of the present invention.

As shown in the figure, the fifth embodiment of the present invention is not provided with an outer door, contrary to the preferred embodiment of the present invention. That is, in the fifth embodiment of the present invention, the front external appearance of the refrigerator door is defined by a front decoration 590. The front decoration 590, which is formed of a single transparent plate, may be colored with a predetermined color or figured with a predetermined pattern.

In addition, a door liner 556 is provided on the rear of the front decoration 590. The door liner 556, which defines a rear external appearance of the door, is fixed to the rear of the front decoration 590 in a process of forming an insulating layer (not shown) by solidifying foam liquid which will be described below.

Door decorations 582 are coupled to both side ends of the front decoration 590. The door decorations 582, which define both side external appearances of the door, are respectively formed with fastening grooves 589 on surfaces of the respective door decorations 582 facing each other. The fastening grooves 589 are formed to vertically extend, and both the side ends of the front decoration 590 are respectively inserted into the fastening grooves 589.

Cap decorations 580 are coupled to upper and lower ends of the front decoration 590. In the cap decorations 580 which define top and bottom external appearances of the door, coupling grooves 588, into which the upper and lower ends of the front decoration 590 are inserted, are respectively formed on surfaces of the cap decorations 580 facing each other. In addition, the outside upper and lower ends of the door decorations 582 are brought into close contact with both sides of the cap decorations 580, respectively.

In addition, a display portion 570 is installed on the rear surface of the front decoration 590. The display portion 570 is connected to a control section (not shown) of a refrigerator, and thus serves to receive an operating signal for operating the refrigerator by means of touch screen and to display various information connected with the operation of the refrigerator to the outside. The display portion 570 is temporarily attached to a side of the rear surface of the front decoration 590 with a double sided tape (not shown).

Hereinafter, a manufacturing method of the refrigerator door according to the fifth embodiment of the present invention will be described in detail with reference to the accompanying drawings.

FIGS. 16 to 20 are views showing a process of manufacturing the refrigerator door according to the fifth embodiment of the present invention;

First, as shown in FIG. 16, the display portion 570 is installed to a side of the rear surface of the front decoration 590. At this time, the display portion 570 is temporarily attached to the rear surface of the front decoration 590 with a double sided tape or other attaching means.

Then, as shown in FIG. 17, the door decorations 582 are respectively coupled to both the side ends of the front decoration 590. At this time, both the side ends of the front decoration 590 are respectively inserted into the fastening grooves 589 of the door decorations 582.

Also, as shown in FIG. 18, the cap decorations 580 are coupled to the upper and lower ends of the front decoration 590 to which the door decorations 582 are coupled, respectively. At this time, the upper and lower ends of the front decoration 590 are inserted into the coupling grooves 588 of the cap decorations 580, and the outside upper and lower ends of the door decorations 582 are respectively brought into close contact with both the side ends of the cap decorations 580.

In such a state, as shown in FIG. 19, the front decoration 590 to which the door decorations 582 and the cap decorations 580 are coupled is oriented for the front of the front decoration 590 is directed downward. That is, the opening portion of the space defined by the front decoration 590, the door decorations 582 and the cap decorations 580 is directed upward with respect to the figure. Then, foam liquid is injected into the space defined by the front decoration 590, the door decorations 582 and the cap decorations 580.

In the meantime, as shown in FIG. 20, if the injection of the foam liquid is completed, the door liner 556 is positioned over the opening portion of the space defined by the front decoration 590, the door decorations 582 and the cap decorations 580, i.e., the upper face in the figure. Then, the door liner 556 is fixed in a predetermined position by solidification of the foam liquid.

Sixth Embodiment

Hereinafter, a sixth embodiment of the present invention will be described in detail with reference to the accompanying drawings.

FIG. 21 is a perspective view showing a refrigerator door in which the sixth embodiment of the present invention is employed, and FIG. 22 is a front view showing that a display device according to the sixth embodiment of the present invention is mounted to the refrigerator door.

As shown in the figures, the sixth embodiment of the present invention comprises a display portion 670 including a display section 674 for informing a user of an operating condition of the refrigerator and a control section 676 for controlling an operating condition of the refrigerator. At this time, the display section 674 includes a colored portion 678 which is colored by a predetermined width along a peripheral portion of the display section 674. It is preferred that the colored portion 678 be colored with the same color as a front decoration 690, which will be described below.

The front decoration 690 is installed on the front of the display portion 670. An edge portion of the front decoration 690 is inserted into and installed to coupling grooves 689 formed in cap decorations 680 and fastening grooves 688 formed in door decorations 682, respectively. The rear of the front decoration 690 is colored with a color by which the external appearance of the refrigerator intends to be represented, and preferably, with the same color as the colored portion 678. A transparent window 692 is formed in a portion corresponding to the display section 674 so that the display section 674 can be observed. In addition, input positions 694 are printed at positions corresponding to the control section 676 of the display portion 670 in order for a user to confirm the input positions 694. At this time, the transparent portion of the rear of the front decoration 690 is formed so that its edge portion overlaps with the colored portion 678 by a predetermined width.

When the front decoration 690 is installed on the front of the display portion 670, the transparent portion of the front decoration 690 are located at the same position as the display section 674 of the display portion 670. At this time, the transparent portion of the front decoration 690 is positioned so as to partially overlap with the colored portion 678 of the display section 674, thus generating a somewhat overlapping portion 696, as shown in FIG. 22.

Therefore, even if a fine gap occurs between the transparent portion of the front decoration 690 and the display section 674, the colored portion 678 causes the observation through the gap from the outside to be impossible.

The scope of the present invention is not limited to the embodiments described above but is defined by the claims. It will be apparent that those skilled in the art can make various modifications and changes thereto within the scope of the invention defined by the claims.

For example, although herein, the respective embodiments are carried out independent of each other, it is apparent that the present invention can be carried out by duplicately applying the respective embodiments.

[Industrial Applicability]

According to the present invention so configured as described above, since there is no protruding portion on an external appearance of a refrigerator, there is an advantage in that the external appearance of the refrigerator is neat and the cleaning of the external appearance is easy. In addition, a front of a refrigerator door is formed of a single transparent plate and a display portion is stably provided in an outer door, so that an assembling error does not occur during the installation of the display portion.

The invention claimed is:

1. A refrigerator door, comprising:

an outer door;

a display accommodating portion recessed in a front surface of the outer door;

a door liner provided at a rear of the outer door to define a rear of the refrigerator door;

an insulating layer interposed between the outer door and the door liner;

a display portion received in the display accommodating portion;

a front decoration formed of a transparent plate and covering the outer door and the display portion to define a front external appearance of the refrigerator door;

a pair of cap decorations provided on upper and lower portions of the outer door and the door liner to define top and bottom external appearances of the refrigerator door; and a pair of door decorations coupled to both sides of the outer door and door liner to define both side external appearances of the refrigerator door, wherein the display portion includes:

a display section for showing an operating condition of a refrigerator; and an input section for receiving a user's command, wherein a rear surface of the front decoration is colored except for at least a portion defining a viewing window which overlies the display section, and wherein an input mark is located on a portion of the front decoration and overlies the input section.

2. The refrigerator door as claimed in claim 1, wherein the front decoration is formed of a plastic member.

3. The refrigerator door as claimed in claim 1, wherein the front decoration is formed of a glass member.

4. The refrigerator door as claimed in claim 1, wherein the cap decorations and the door decorations are formed with fastening grooves, and the front decoration is fitted into the fastening grooves of the cap and door decorations and supported thereto.

5. The refrigerator door as claimed in claim 1, wherein a side of the display accommodating portion is stepwise fainted to have a seating surface defined, and a rear of the display portion is formed to have a step corresponding to the display accommodating portion, whereby the rear of the display portion is seated on the seating surface.

6. The refrigerator door as claimed in claim 5, wherein the seating surface is provided with a shock absorbing member formed of an elastic material.

7. The refrigerator door as claimed in claim 1, further comprising an elastic member installed on a lower end of the display accommodating portion and elastically supporting the display portion upward.

8. The refrigerator door as claimed in claim 7, wherein the elastic member is an elastic rib formed by curvedly bending an elastic material.

9. The refrigerator door as claimed in claim 8, wherein a seating groove in which the elastic rib can be seated is formed in a bottom surface of the display portion.

10. The refrigerator door as claimed in claim 9, wherein the cap decorations and the door decorations are formed with fastening grooves, and the front decoration is fitted into the fastening grooves of the cap and door decorations and supported thereto.

11. The refrigerator door as claimed in claim 1, wherein any one of a side of the display accommodating portion and a side of the display portion is formed with a guide protrusion, and the other one is formed with a guide groove for guiding movement of the guide protrusion.

12. The refrigerator door as claimed in claim 11, wherein the guide groove and the guide protrusion are provided on each of both sides of the display portion and each of both sides of the display accommodating portion.

13. The refrigerator door as claimed in claim 11, wherein the guide groove is formed to be curved according to an insertion of the display portion for the guide protrusion to be inserted into the guide groove while the display portion rotates.

14. The refrigerator door as claimed in claim 1, wherein support plates are formed to extend from both sides of the display portion, and support plate insertion portions are formed in both sides of the display accommodating portion, the support plate insertion portion being depressed to have a size corresponding to the support plate for the support plate to be seated in the support plate insertion portion, whereby the support plates are fixed to the outer door and thus the display portion is fixed to the display insertion portion.

15. The refrigerator door as claimed in claim 14, wherein fixing plates are respectively formed on insides of the door decorations to be provided on the support plates and to be fixed to the outer door through the support plates.

16. The refrigerator door as claimed in claim 1, wherein the display portion includes a display section with a peripheral portion colored, and the front decoration includes a portion partially overlapping with the colored peripheral portion of the display section, wherein the partially overlapping portion of the front decoration is colored with the same color as the peripheral portion of the display portion.

17. The refrigerator door as claimed in claim 1, wherein the display portion is attached to a rear surface of the front decoration.

18. The refrigerator door as claimed in claim 1, wherein the display portion is attached to a rear surface of the front decoration by double sided tape.

19. The refrigerator door according to claim 1, wherein the front decoration is a single piece, and the front decoration, in combination with the pair of cap decorations and the pair of door decoration, covers the entire front surface of the outer door.

20. The refrigerator door according to claim 1, wherein the front decoration is continuous over the display accommodation portion.

21. The refrigerator door according to claim 1, wherein the portion of the front decoration defining the viewing window contacts the display section.

22. The refrigerator door according to claim 1, wherein the input portion is a printed portion on the front decoration, the printed portion contacting the input section.

23. The refrigerator door according claim 1, wherein the front decoration is colored except for the portion defining the viewing window.

* * * * *